US008006445B2

(12) United States Patent
Burton et al.

(10) Patent No.: US 8,006,445 B2
(45) Date of Patent: Aug. 30, 2011

(54) SELF-SEALING WINDOW INSTALLATION AND METHOD

(75) Inventors: Cordell R. Burton, Pella, IA (US); Scot C. Miller, Pella, IA (US); Gabriel P. Gromotka, Pella, IA (US)

(73) Assignee: Pella Corporation, Pella, IA (US)

( * ) Notice: Subject to any disclaimer, the term of this patent is extended or adjusted under 35 U.S.C. 154(b) by 380 days.

(21) Appl. No.: 12/014,531

(22) Filed: Jan. 15, 2008

(65) Prior Publication Data

US 2008/0110110 A1 May 15, 2008

Related U.S. Application Data

(63) Continuation-in-part of application No. 11/427,636, filed on Jun. 29, 2006, now Pat. No. 7,669,382.

(60) Provisional application No. 60/975,450, filed on Sep. 26, 2007.

(51) Int. Cl.
*E06B 3/00* (2006.01)
*E06B 1/04* (2006.01)

(52) U.S. Cl. ..... 52/204.55; 52/214; 52/213; 49/475.1

(58) Field of Classification Search ..... 52/204.53, 52/216, 215, 211, 204.55, 214, 213; 49/475.1; 296/146.2

See application file for complete search history.

(56) References Cited

U.S. PATENT DOCUMENTS

| | | | | |
|---|---|---|---|---|
| 304,183 | A | 8/1884 | Davis | |
| 396,327 | A | 1/1889 | Crane | |
| 1,377,349 | A | 5/1921 | Holder | |
| 1,429,527 | A | 9/1922 | Paul | |
| 1,668,564 | A | 5/1928 | Jenkins | |
| 1,836,980 | A | 12/1931 | Marty | |
| 1,881,778 | A | 10/1932 | Madsen | |
| 1,929,633 | A | 10/1933 | Gifford | |
| 2,001,602 | A * | 5/1935 | Dietz | 49/475.1 |
| 2,093,614 | A * | 9/1937 | Lynch | 52/208 |

(Continued)

FOREIGN PATENT DOCUMENTS

| | | |
|---|---|---|
| WO | WO 94-00655 | 1/1994 |

(Continued)

OTHER PUBLICATIONS

Jeld Wen Windows and Doors, "Installation Instructions for New Construction Vinyl Window with Integral Nailing Fin," 6 pp., Mar. 2003.

(Continued)

*Primary Examiner* — Robert J Canfield
*Assistant Examiner* — Brent W Herring
(74) *Attorney, Agent, or Firm* — Faegre & Benson LLP

(57) ABSTRACT

A self-sealing window with a flexible gasket that extends around the entire perimeter of closure assemblies and a method of installing such closure assemblies in a rough opening. A sealing member is attached continuously around an entire perimeter of the closure assembly to form a water impermeable seal between the sealing member and the closure assembly. The closure assembly is inserted into the rough opening. Accurate positioning of the closure assembly in the rough opening is verified. The closure assembly is secured in the rough opening. The sealing member is engaged with an exterior surface of the structure proximate the rough opening. A foam material is delivered into at least a portion of a space between perimeter edge surfaces of the closure assembly and inner surfaces of the rough opening.

16 Claims, 18 Drawing Sheets

U.S. PATENT DOCUMENTS

| | | | | | |
|---|---|---|---|---|---|
| 2,169,985 | A | | 8/1939 | Hiza | |
| 2,305,252 | A | | 12/1942 | Hayden | |
| 2,326,549 | A | * | 8/1943 | Miller | 52/211 |
| 2,497,515 | A | | 2/1950 | Pearse | |
| 2,624,067 | A | | 1/1953 | Tassell | |
| 2,700,441 | A | | 1/1955 | Cudini | |
| 2,879,660 | A | | 3/1959 | Reintjes | |
| 2,952,947 | A | | 9/1960 | White | |
| 3,192,670 | A | | 7/1965 | Jones, III | |
| 3,250,049 | A | | 5/1966 | Sklar | |
| 3,358,402 | A | * | 12/1967 | Sahm | 49/401 |
| 3,375,627 | A | * | 4/1968 | Bursiek et al. | 52/213 |
| 3,566,542 | A | | 3/1971 | Gillen et al. | |
| 3,571,996 | A | | 3/1971 | Braswell | |
| 3,585,770 | A | | 6/1971 | Maizler | |
| 3,599,379 | A | | 8/1971 | Tuska | |
| 3,681,876 | A | | 8/1972 | Linder et al. | |
| 3,690,079 | A | | 9/1972 | Hemminger | |
| 3,692,040 | A | | 9/1972 | Kundert | |
| 3,782,064 | A | | 1/1974 | Hubbard et al. | |
| 3,811,150 | A | | 5/1974 | Chalmers | |
| 3,851,420 | A | | 12/1974 | Tibbetts | |
| 3,861,444 | A | * | 1/1975 | Portwood | 160/90 |
| 3,889,423 | A | | 6/1975 | Begin | |
| 3,919,815 | A | | 11/1975 | Alabaster | |
| 3,963,269 | A | | 6/1976 | Rosenberg | |
| 4,001,972 | A | | 1/1977 | Hurwitz | |
| 4,055,923 | A | | 11/1977 | Biebuyck | |
| 4,080,763 | A | | 3/1978 | Naidus et al. | |
| 4,084,361 | A | * | 4/1978 | Aspaas | 52/204.593 |
| 4,141,190 | A | | 2/1979 | Shimada | |
| 4,147,006 | A | * | 4/1979 | Kruschwitz | 52/204.599 |
| 4,228,630 | A | | 10/1980 | Englert et al. | |
| 4,295,299 | A | | 10/1981 | Nelson | |
| 4,299,060 | A | | 11/1981 | Tippmann | |
| 4,330,972 | A | | 5/1982 | Sailor | |
| 4,341,048 | A | * | 7/1982 | Minter | 52/204.53 |
| 4,387,542 | A | | 6/1983 | Wehr | |
| 4,406,300 | A | | 9/1983 | Wilson | |
| 4,407,100 | A | * | 10/1983 | Huelsekopf | 52/204.54 |
| 4,462,190 | A | | 7/1984 | Allen | |
| 4,473,981 | A | * | 10/1984 | Simpson | 52/204.53 |
| 4,488,391 | A | | 12/1984 | Pavnica | |
| 4,489,517 | A | | 12/1984 | Young | |
| 4,544,593 | A | | 10/1985 | Borgert et al. | |
| 4,555,882 | A | | 12/1985 | Moffit et al. | |
| 4,563,846 | A | | 1/1986 | Webb | |
| 4,621,478 | A | | 11/1986 | Phillips et al. | |
| 4,627,206 | A | | 12/1986 | Cox | |
| 4,637,183 | A | | 1/1987 | Metz | |
| 4,644,717 | A | | 2/1987 | Biebuyck | |
| 4,672,784 | A | | 6/1987 | Pohlar | |
| 4,691,487 | A | | 9/1987 | Kessler | |
| 4,694,612 | A | | 9/1987 | Pruden et al. | |
| 4,700,512 | A | | 10/1987 | Laska | |
| 4,713,922 | A | | 12/1987 | Ingold | |
| 4,715,152 | A | | 12/1987 | Tanikawa | |
| 4,731,952 | A | | 3/1988 | Mascotte | |
| 4,731,965 | A | | 3/1988 | Jensen | |
| 4,821,472 | A | | 4/1989 | Tix | |
| 4,837,977 | A | * | 6/1989 | Mauro | 49/501 |
| 4,844,520 | A | | 7/1989 | Muller, Jr. | |
| 4,852,312 | A | | 8/1989 | Harbom | |
| 4,854,621 | A | | 8/1989 | Baldwin | |
| 4,887,407 | A | | 12/1989 | Nelson | |
| 4,918,786 | A | | 4/1990 | Perry | |
| 4,958,469 | A | * | 9/1990 | Plummer | 52/204.55 |
| 5,018,333 | A | * | 5/1991 | Bruhm | 52/741.4 |
| 5,026,581 | A | | 6/1991 | Shea, Jr. et al. | |
| 5,042,199 | A | | 8/1991 | Schneider et al. | |
| 5,054,250 | A | | 10/1991 | Foss | |
| 5,081,793 | A | * | 1/1992 | Mauro | 49/501 |
| 5,115,605 | A | | 5/1992 | Butler | |
| 5,119,609 | A | * | 6/1992 | Tait et al. | 52/213 |
| 5,179,969 | A | | 1/1993 | Peterson | |
| 5,207,029 | A | * | 5/1993 | Nozaki et al. | 49/495.1 |
| 5,299,399 | A | | 4/1994 | Baier et al. | |
| 5,319,884 | A | | 6/1994 | Bergeron | |
| 5,327,684 | A | | 7/1994 | Herbst | |
| 5,365,697 | A | | 11/1994 | Vanderpan | |
| 5,365,707 | A | * | 11/1994 | Jones et al. | 52/211 |
| 5,394,657 | A | | 3/1995 | Peterson | |
| 5,423,149 | A | | 6/1995 | Herbst | |
| 5,524,391 | A | | 6/1996 | Joffe et al. | |
| 5,542,217 | A | | 8/1996 | Larivee, Jr. | |
| 5,570,917 | A | | 11/1996 | Cutrer | |
| 5,572,840 | A | * | 11/1996 | Fast et al. | 52/213 |
| 5,586,415 | A | | 12/1996 | Fisher et al. | |
| 5,593,771 | A | | 1/1997 | Lawless et al. | |
| 5,603,585 | A | * | 2/1997 | Bruchu et al. | 403/382 |
| 5,611,180 | A | * | 3/1997 | Agrawal et al. | 52/393 |
| 5,647,172 | A | | 7/1997 | Rokicki | |
| 5,655,342 | A | | 8/1997 | Guillemet et al. | |
| 5,655,343 | A | | 8/1997 | Seals | |
| 5,675,870 | A | | 10/1997 | Cooper | |
| 5,682,713 | A | | 11/1997 | Weiss | |
| 5,687,519 | A | * | 11/1997 | Bruchu | 52/213 |
| 5,692,350 | A | | 12/1997 | Murphy, Jr. | |
| 5,701,780 | A | | 12/1997 | Ver Meer | |
| 5,722,207 | A | | 3/1998 | Anderson et al. | |
| 5,822,933 | A | | 10/1998 | Burroughs et al. | |
| 5,839,236 | A | | 11/1998 | Frey | |
| 5,857,299 | A | | 1/1999 | Gyllenberg et al. | |
| 5,890,331 | A | | 4/1999 | Hope | |
| 5,899,026 | A | | 5/1999 | Williams et al. | |
| 5,921,038 | A | | 7/1999 | Burroughs et al. | |
| 5,927,039 | A | | 7/1999 | De Boer | |
| 5,934,828 | A | | 8/1999 | Hu et al. | |
| 5,937,597 | A | | 8/1999 | Sono et al. | |
| 5,941,032 | A | * | 8/1999 | Lydon, Jr. | 52/204.1 |
| 6,014,846 | A | | 1/2000 | Sono et al. | |
| 6,018,916 | A | | 2/2000 | Henry | |
| 6,098,343 | A | | 8/2000 | Brown et al. | |
| 6,141,922 | A | * | 11/2000 | Carlisle et al. | 52/204.1 |
| 6,170,198 | B1 | | 1/2001 | Staples et al. | |
| 6,185,792 | B1 | | 2/2001 | Nelson et al. | |
| 6,216,402 | B1 | | 4/2001 | Van de Laar | |
| 6,223,484 | B1 | | 5/2001 | Minter | |
| 6,256,956 | B1 | | 7/2001 | Davis | |
| 6,276,099 | B1 | | 8/2001 | O'Shea | |
| 6,293,061 | B1 | * | 9/2001 | Horak, Jr. | 52/213 |
| 6,295,774 | B1 | | 10/2001 | Lindgren | |
| 6,305,130 | B1 | | 10/2001 | Ackerman, Jr. | |
| 6,327,820 | B1 | | 12/2001 | Pico | |
| 6,357,200 | B1 | | 3/2002 | Vanderpan | |
| 6,374,557 | B1 | | 4/2002 | O'Donnell | |
| 6,381,911 | B1 | | 5/2002 | Weiland | |
| 6,385,925 | B1 | | 5/2002 | Wark | |
| 6,401,401 | B1 | | 6/2002 | Williams | |
| 6,401,402 | B1 | | 6/2002 | Williams | |
| 6,405,501 | B1 | | 6/2002 | Cerrato | |
| 6,408,922 | B2 | | 6/2002 | Desrochers | |
| 6,412,240 | B1 | | 7/2002 | Treleven et al. | |
| 6,519,899 | B1 | * | 2/2003 | Hurzeler | 49/501 |
| 6,536,176 | B1 | | 3/2003 | Nordgren et al. | |
| 6,634,146 | B2 | | 10/2003 | Carlson | |
| 6,722,089 | B2 | * | 4/2004 | Budzinski | 52/204.5 |
| 6,725,610 | B2 | * | 4/2004 | Murphy et al. | 52/58 |
| 6,725,622 | B1 | | 4/2004 | Hsu | |
| 6,807,778 | B2 | | 10/2004 | Engebretson | |
| 6,832,457 | B2 | * | 12/2004 | Geiger | 52/656.5 |
| 6,857,232 | B2 | | 2/2005 | Bealko | |
| 6,894,083 | B2 | | 5/2005 | Braun et al. | |
| 6,959,748 | B2 | | 11/2005 | Hudoba | |
| 6,981,348 | B2 | | 1/2006 | Kjorsvik | |
| 7,100,337 | B1 | | 9/2006 | Nordgren et al. | |
| 7,134,246 | B1 | | 11/2006 | Olberding et al. | |
| 7,237,365 | B1 | | 7/2007 | Phandanouvong | |
| 7,331,145 | B2 | | 2/2008 | Feucht | |
| 7,351,472 | B2 | | 4/2008 | Ishikawa et al. | |
| 7,367,164 | B2 | | 5/2008 | Burton et al. | |
| 7,490,441 | B2 | | 2/2009 | Burton et al. | |
| 7,669,382 | B2 | | 3/2010 | Burton et al. | |
| 7,676,996 | B2 | | 3/2010 | Teodorovich | |
| 2001/0034984 | A1 | | 11/2001 | Murphy et al. | |
| 2001/0035268 | A1 | | 11/2001 | Desrochers | |
| 2002/0108326 | A1 | | 8/2002 | Ackerman, Jr. | |

2002/0157328 A1 10/2002 Holder
2003/0046887 A1* 3/2003 Chubb ..... 52/212
2003/0177699 A1 9/2003 Fukuro et al.
2003/0177709 A1 9/2003 Gatherum
2003/0177727 A1 9/2003 Gatherum
2003/0188498 A1 10/2003 Lewkowitz
2003/0226321 A1* 12/2003 Engebretson ..... 52/204.54
2004/0020143 A1* 2/2004 Webb ..... 52/204.53
2005/0011140 A1 1/2005 Ackerman, Jr.
2005/0097837 A1 5/2005 Burton
2005/0138875 A1 6/2005 Grunewald et al.
2005/0144856 A1* 7/2005 Conlin ..... 52/58
2005/0144865 A1 7/2005 Ellingson
2005/0188625 A1 9/2005 Cantrell
2005/0193654 A1 9/2005 Primozich
2005/0235571 A1 10/2005 Ewing et al.
2005/0262771 A1 12/2005 Gorman
2005/0262782 A1* 12/2005 Harrison et al. ..... 52/204.53
2006/0080894 A1* 4/2006 Saelzer ..... 49/504
2006/0101726 A1 5/2006 Collins
2006/0137262 A1 6/2006 Crowder-Moore et al.
2006/0150524 A1 7/2006 Kibbel et al.
2006/0156655 A1* 7/2006 Rizzotto, Sr. ..... 52/215
2006/0213135 A1 9/2006 Mathes et al.
2006/0236618 A1 10/2006 Williams
2006/0272238 A1 12/2006 Honda
2006/0272274 A1 12/2006 Burton et al.
2007/0000180 A1* 1/2007 Oba et al. ..... 49/498.1
2007/0056231 A1 3/2007 DiMario et al.
2007/0094957 A1 5/2007 Burton et al.
2007/0125013 A1 6/2007 Prince
2007/0166498 A1 7/2007 Penar
2007/0214738 A1* 9/2007 Koessler ..... 52/302.6
2007/0289226 A1* 12/2007 Lokkart ..... 52/62
2008/0127564 A1 6/2008 Burton et al.
2008/0245003 A1* 10/2008 Kon et al. ..... 52/208
2009/0084041 A1* 4/2009 Foster et al. ..... 49/479.1

FOREIGN PATENT DOCUMENTS

WO WO 01-71142 9/2001
WO WO 01-81689 11/2001
WO WO 2006-044601 4/2006

OTHER PUBLICATIONS

© Pella Corporation, "Clad Double-Hung Window Installation Instructions," 5 pp., 2004.
© Pella Corporation, "Clad Casement & Awning Window Installation Instructions," 5 pp., 2004.
© Pella Corporation, "Installation Instruction, HurricaneShield™/Advanced Performance Casement and Awning Windows," 4 pp., 2001.
Jamsill, Inc., Jamsill Guard™, http://www.jamsill.com/Products.php, 5 pp., 2005.
U.S. Appl. No. 60/726,573, filed Oct. 14, 2005, 19 pp.
Wood Window Installation, New Wood Frame Construction, Marvin Windows and Doors, Dec. 12, 2006, 13 pages.
Pella Corporation, Clad Frame Entry Door Installation Instructions, 5 pages, 2003.
Pella Corporation, Wood Frame Entry Door & 20 Minute Fire Rated Entry Door Installation Instructions, 5 pages, 2003.
Pella Corporation, "Entry Door—Wood and Clad Double Door installation instructions", 5 pages, 2003.

* cited by examiner

SELF-SEALING WINDOW INSTALLATION AND METHOD

The present application is a continuation-in-part of U.S. patent application Ser. No. 11/427,636 entitled WINDOW INSTALLATION METHOD, filed Jun. 29, 2006, and the present application claims the benefit of U.S. Provisional Application Ser. No. 60/975,450 entitled SELF-SEALING WINDOW AND INSTALLATION METHOD, filed on Sep. 26, 2007, both of which are hereby incorporated by reference.

TECHNICAL FIELD

The present invention relates to a self-sealing window with a flexible gasket that extends around the entire perimeter of closure assemblies and a method of installing such closure assemblies in a rough opening.

BACKGROUND OF THE INVENTION

One of the more time consuming jobs in the construction and restoration fields is the setting (i.e. installing, leveling, and plumbing) of closures assemblies such as doors, windows, side lights, transoms, gable air vents, portals, skylights, etc., in rough structural openings. The rough opening is typically slightly larger than the closure assembly to facilitate installation.

Installers typically use wooden shims placed and sometime driven in the gap between the closure frame or jamb and the wall studs that form the rough opening. A level is used during this process to confirm the positioning of the jamb in the opening and re-adjustment of the shims is made as necessary to complete the installing, leveling and plumbing process. Levels are used on closures that have a flat vertical or horizontal side or sides. A plumb line is used on closures where a level is ineffective, such as a circular or oval closure.

Although the wooden shim is still the dominant means today for installing closures, it does have some limitations including: (1) the method of installing with wood shims is very time consuming; (2) wood shims are difficult to use on rounded surfaces (i.e. circular, oval-portals, stained glass ovals, etc.); (3) wood shims often interfere with complete sealing of the window to the rough opening; and (4) wood shims can slip out of place during installation of the closure assembly.

A gap is typically maintained between the closure assembly and the rough opening to accommodate expansion and contraction of building materials throughout temperature changes, as well as overall shifting and settling of the structure. Water, such as airborne moisture and liquid water in the form of rainwater, ice, snow can penetrate into the building wall interior from in and around building closure assemblies.

Attempts have been made to prevent entry of water into the building wall interior by sealing or caulking entry points in and around closure assemblies as the primary defense against water intrusion, or by installing flashing around the closure assemblies to divert the water. These attempts have not been completely successful. Sealants are not only difficult and costly to properly install, but tend to separate from the closure assembly or wall due to climatic conditions, building movement, the surface type, or chemical reactions. Flashing is also difficult to install and may tend to hold the water against the closure assembly, accelerating the decay.

The efficiency of such weatherproofing relies largely on the careful installation of both the closure assembly and the weatherproofing materials. However, no matter how carefully installed, moisture may enter into gaps between the closure assembly and the rough opening. Moisture penetration may be due to shifting or expansion/contraction of materials post-installation.

Such moisture typically collects below the closure assembly, where it can cause rot and other undesirable damage to both the closure assembly and the structure below the closure assembly. In some situations attempts to prevent water penetration around closure assemblies may actually trap the water within the structure, exacerbating the problem.

Various drain holes systems for closure assemblies have been used to divert water from the structure, such as disclosed in U.S. Pat. Nos. 3,851,420 (Tibbetts); 4,691,487 (Kessler); and 5,890,331 (Hope).

Specialized flashing structures have been developed for installation in the gap between the rough opening and the closure assembly. Examples of such specialized flashing structures are shown in U.S. Pat. Nos. 4,555,882 (Moffitt et al.); 5,542,217 (Larivee); and 6,098,343 (Brown et al.). U.S. Pat. Nos. 5,822,933 (Burroughs et al.) and 5,921,038 (Burroughs et al.) disclose a water drainage system with an angled pan and a plurality of ribs that is located underneath a closure assembly.

These specialized flashing structures, however, do not effectively remove water from the interior of the structure. Additionally, the installation of moisture guards often requires changes in the way the closure assembly is installed into the rough opening and how the closure assembly is finished on the room side so as to accommodate the vertical height of the angled pan. Furthermore, the gap between the closure assembly and the rough opening must be sufficient to accommodate the raised end of the angled pan.

The Installation Instructions for New Construction Vinyl Window with Integral Nailing Fin published by Jeld-Wen, Inc. discloses installing a 6" tall section of screen to the exterior of the structure below the closure assembly. The screen extends about the width of the closure assembly and is located on top of flashing tape and building wrap. Another layer of flashing tape is applied to the top of the screen. The screen, however, forms one contiguous channel that is too large to permit effective drainage of water.

BRIEF SUMMARY OF THE INVENTION

Various embodiments of the present invention relate to a self-sealing window with a flexible sealing member that extends around the entire perimeter of closure assemblies and a method of installing such closure assemblies in a rough opening. The installation methods reduce the time and cost of installing closure assemblies, while increasing the performance of the closure assembly.

The method of installing a closure assembly in a rough opening of a structure includes the step of attaching a sealing member continuously around an entire perimeter of the closure assembly to form a water impermeable seal between the sealing member and the closure assembly. The closure assembly is accurately positioned in the rough opening and secured in place. The sealing member is engaged with an exterior surface of the structure proximate the rough opening. A foam material is delivered into at least a portion of a space between perimeter edge surfaces of the closure assembly and inner surfaces of the rough opening.

The present application is also directed to a closure assembly for installation in a rough opening of a structure. The closure assembly includes a window frame and at least one glazing panel located within the window frame. At least one sealing member is attached to, and extends continuously around, a perimeter of the window frame. The sealing member comprises a water impermeable seal around the entire perimeter of the closure assembly.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1A:
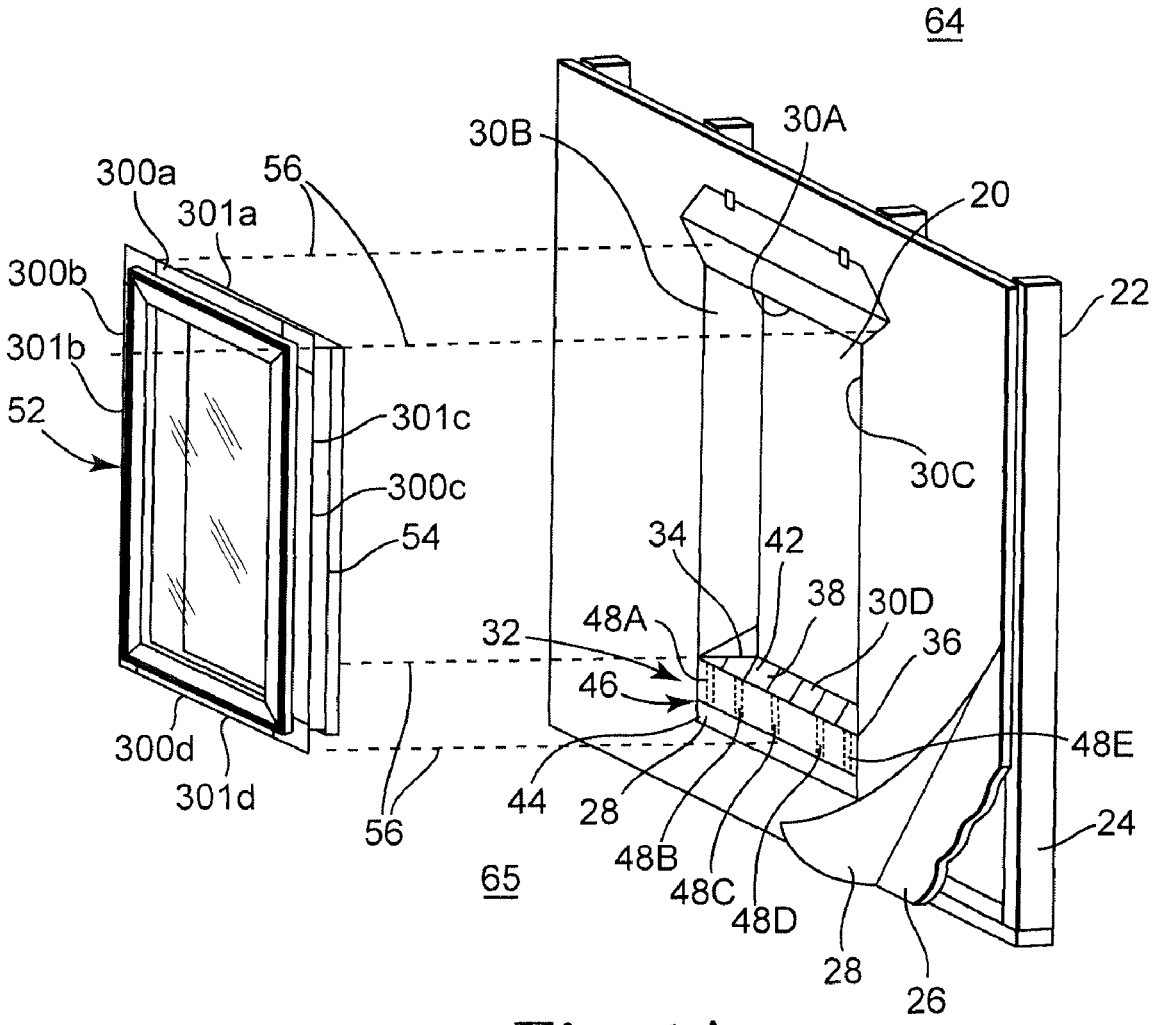
FIG. 1A is an exploded perspective view of an exterior installation of a closure assembly with a drainage system in accordance with one embodiment of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION OF THE INVENTION

The present invention is directed to a self-sealing closure assembly and system for installing a closure assembly in a rough opening. As used herein, "closure" and "closure assembly" refer to double-hung, casement, awning and fixed windows, skylights, sliding and hinged doors, and the like. As used herein, "rough opening" refers to an opening in a wall or structure that has a perimeter sized and shaped to receive a closure assembly, and a plurality of inner surfaces. As used herein, "inner surfaces" refers to the sill, header and jamb surfaces forming the rough opening in the wall or structure. The rough opening extends from an interior side of the structure to an exterior side. The exterior side of the structure is typically exposed to rain, wind, snow, ice and the like, while the interior side is typically protected from the elements.

FIG. 1A illustrates a structure 22 that includes framing members 24, a sheathing layer 26 and a water resistant barrier 28. In another embodiment, the structure 22 is formed of a composite panel and a water resistant barrier 28. A rough opening 20 extends through the structure 22 from an interior side 64 of the structure 22 to an exterior side 65. The water resistant barrier 28 preferably wraps around at least a portion of inner surfaces 30B, 30C, 30D of a rough opening 20 in the structure 22. The water resistant barrier 28 preferably wraps onto inner surface 30D located at the bottom of the rough opening 20. A method of wrapping the water resistant barrier 28 is discussed in greater detail herein. In other embodiments, however, the water resistant barrier 28 is not wrapped onto the inner surfaces of the rough opening 20.

In one embodiment, sealing members 300*a*-300*d* are attached substantially around a perimeter of closure assembly 52 at a remote location. As used herein, "remote location" refers a location remote from the rough opening 20, such as a manufacturing facility, warehouse, or construction materials preparation site. The sealing members 300*a*-300*d* is preferably factory installed prior to the closure assembly 52 being shipped to the installation site.

In one embodiment, distal edges 301*a*-301*d* of the sealing members 300*a*-300*d* are positioned toward an exterior side of the closure assembly 52 (corresponding to the exterior side 65 of the structure) for installation. In the illustrated embodiment, the sealing members 300*a-d* are butyl flashing tape. In an alternate embodiment, the flashing tape includes a foil backing. However, the sealing members 300*a*-300*d* may have other configurations as are known in the art, some of which are discussed in further detail later on. In addition, sealing members 300*a*-300*d* may be replaced with a single continuous sealing member.

Figure 1B:
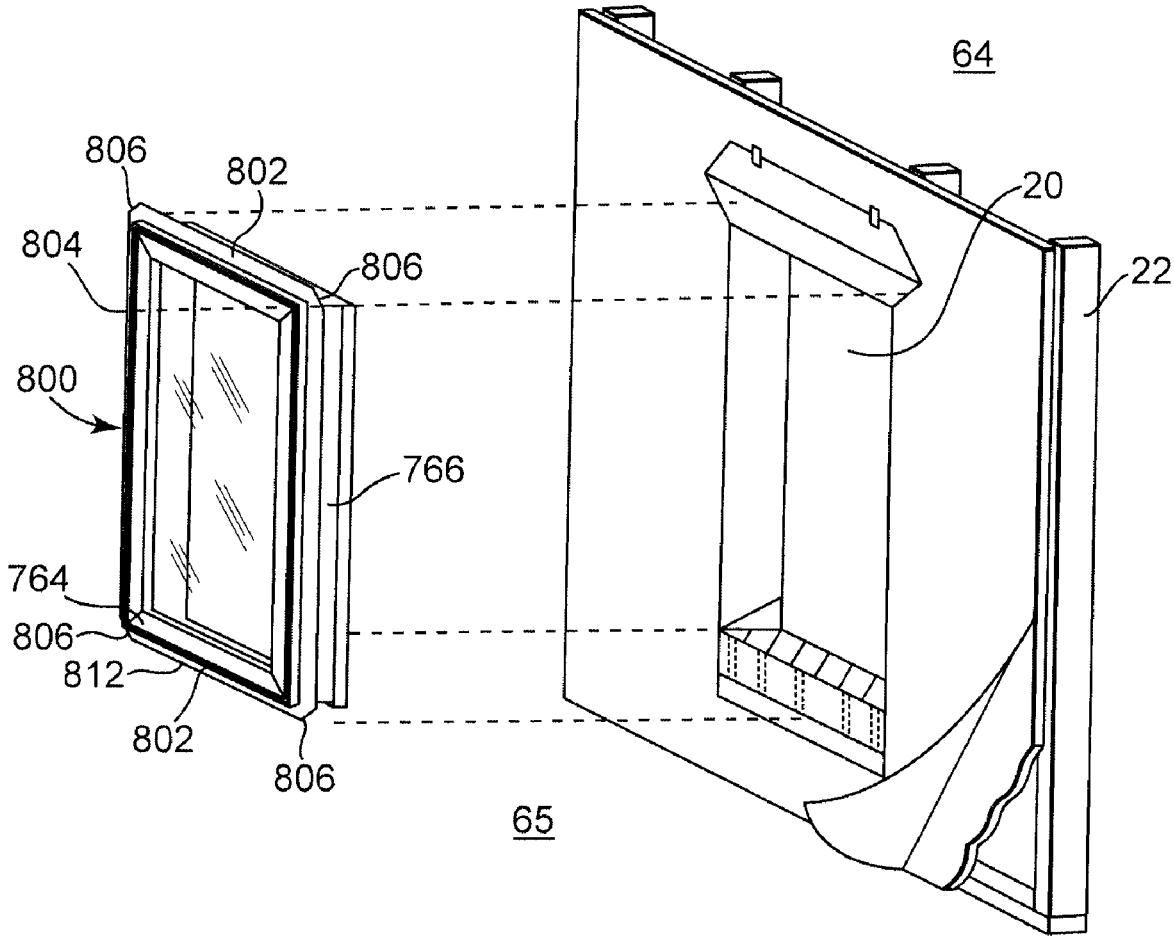
FIG. 1B is an exploded perspective view of an exterior installation of a closure assembly with a continuous sealing member in accordance with one embodiment of the present invention.

FIG. 1B illustrates an alternate closure assembly 800 in accordance with an alternate embodiment. Sealing member 802 is a continuous segment of water impermeable material attached to, and extending continuously around, an entire perimeter of the closure assembly 800. By creating an unbroken seal around the entire perimeter of the closure assembly 800, the sealing member 802 creates a water impermeable seal with the closure assembly 800.

The sealing member 802 can be constructed as a continuous segment or ring, preferably with a generally planar structure. In embodiments where the sealing member 802 is a continuous segment, seam 812 where the ends of the segment meet preferably overlap and are sealed with an adhesive, thermal or solvent welding, or a variety of other water impermeable sealing methods. In one embodiment of FIG. 1B, the seam 812 is located at the bottom of the closure assembly 800, but can be located anywhere around the perimeter 804. The water impermeable seam 812, if any, is preferably formed at a location other than the installation site, such as for example a manufacturing factory, and is positioned at a location other than a corner of the closure assembly. While the sealing member may include multiple broke and/or unbroken layers, at least one unbroken layer preferably forms the sealing member 802.

The sealing member 802 provides a continuous seal around the corners 806, where leakage often occurs. Any seam in the sealing member 802 is preferably formed at a location other than the corners 806. As used herein, "continuous corner seal" refers to a sealing member that extends uninterrupted around, and is continuously attached to, a corner of a closure assembly. In the preferred embodiment, the sealing member comprises continuous corner seals with all corners of the closure assembly.

The sealing member 802 is flexible and preferably can be stretched at the corners 806 to create a seal completely around the perimeter 804. The sealing member 802 is preferably elastically or plastically deformable, without compromising the water impermeability. The sealing member 802 can be a single layer or multi-layer structure, with or without an adhesive layer.

The sealing member 802 may experience bulging or deformation at the corners 806. In some embodiments, relief cuts are made in the sealing member 802 to relieve stress at the corners 806. The relief cuts can be surface cuts or partial severing of the sealing member 802 at the distal edges near the corners 806. The relief cuts preferably do not sever or cut completely through the sealing member 802. In an alternate embodiment, the sealing member 802 is heated to relieve stress at the corners 806. Pressure can optionally be applied to the corners 806, either alone or in combination with heat. Plastic deformation of the sealing member 802 at the corners 806 preferably does not compromise water impermeability.

In one embodiment, the sealing member 802 is captured between the frame 766 and the metal cladding 764 around the entire perimeter 804 of the closure assembly 800. (See e.g., FIGS. 3A, 3B, 3C). The frame 766 may be made of wood, metal, thermoset or thermoplastic polymers, and the like. Alternatively, the sealing member 802 can be secured to the closure assembly 800 using adhesives, fasteners, engagement features formed in the closure assembly 800, and the like to provide a water impermeable seal between the sealing member 802 and the closure assembly 800, such as illustrated in FIG. 3D.

Figure 1C:
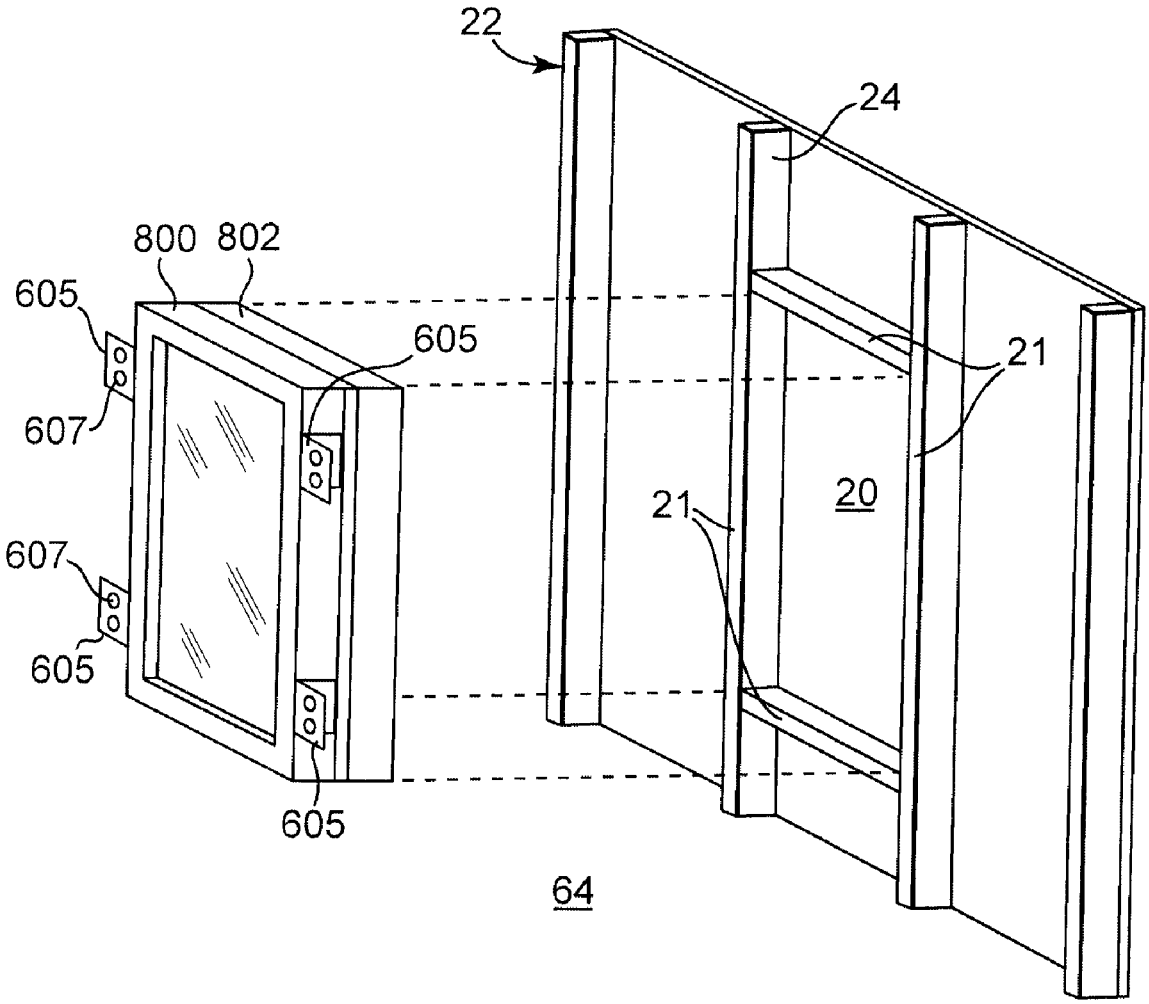
FIG. 1C is an exploded perspective view of an interior installation of a closure assembly with a continuous sealing member in accordance with one embodiment of the present invention.

FIG. 1C illustrates the closure assembly 800 of FIG. 1B configured for installation from the interior side 64. The sealing member 802 is folded forward to permit passage through the rough opening 20 from the interior side 64. As will be discussed in detail below, the closure assembly 800 is attached to interior surfaces 21 of the rough opening 20 by securing members 605, such as the securing members illustrated in FIG. 10 or 11. The sealing member 802 is then folded back into engagement with the structure 22 (see e.g., FIGS. 19 and 20).

The position of the securing members 605 on the closure assembly 800 are preferably located to control the depth of penetration of the closure assembly 800 in the rough opening 20. For example, the depth of penetration needs to take into consideration the thickness of wall board and the shape of finish trim. In one embodiment, the location of the securing members 605 is determined at a remote location, such as the factory. In another embodiment, the installer can adjust the location of the securing members 605 at the installation site. In the illustrated embodiment, the securing members 605 include holes 607 sized and positioned to receive fasteners adapted to engage with the rough opening 20.

Figure 2:
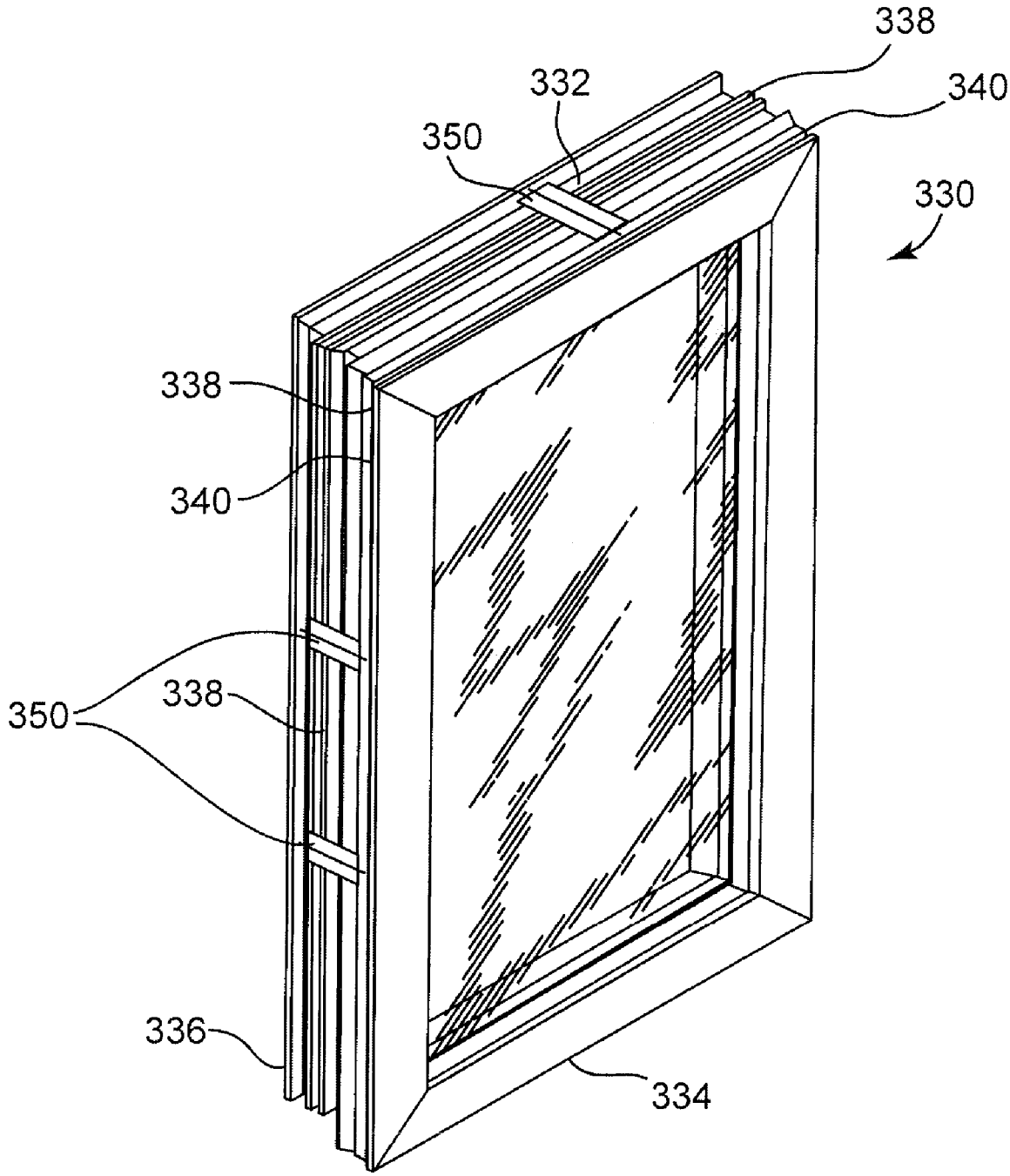
FIG. 2 is a perspective view of a closure assembly and an adjustable shim in accordance with one embodiment of the present invention.

FIG. 2 illustrates an exemplary closure assembly 330 for installation in the rough opening 20. Closure assembly 330 may be substituted for closure assembly 52 in the embodiments shown in FIGS. 1A, 1B, and 1C. Closure assembly 330 includes a frame 332 with an exterior sealing plane 334 and an interior sealing plane 336. As used herein, "exterior sealing plane" refers to a plane extending across the generally outermost external surfaces of the closure assembly 330. As used herein, "interior sealing plane" refers to a plane extending across the generally outermost internal surfaces of the closure assembly 330.

Located generally between the exterior sealing plane 334 and the interior sealing plane 336 of the closure assembly 330 is a perimeter edge surface 338. The perimeter edge surface 338 includes one or more surfaces on the perimeter of the closure assembly 330 that extend between the exterior and interior sealing planes 334, 336. As used herein, "perimeter edge surface" refers to one or more external surfaces located between interior and exterior sealing planes of a closure assembly.

In one embodiment, the perimeter edge surface 338 includes one or more longitudinal recesses 340. In one embodiment, one or more shims 350 are releasably attached or coupled to the longitudinal recess 340, preferably along each side of the closure assembly 330. The shims 350 may be attached to the closure assembly 330 at a remote location or at the installation site.

Figure 3A:
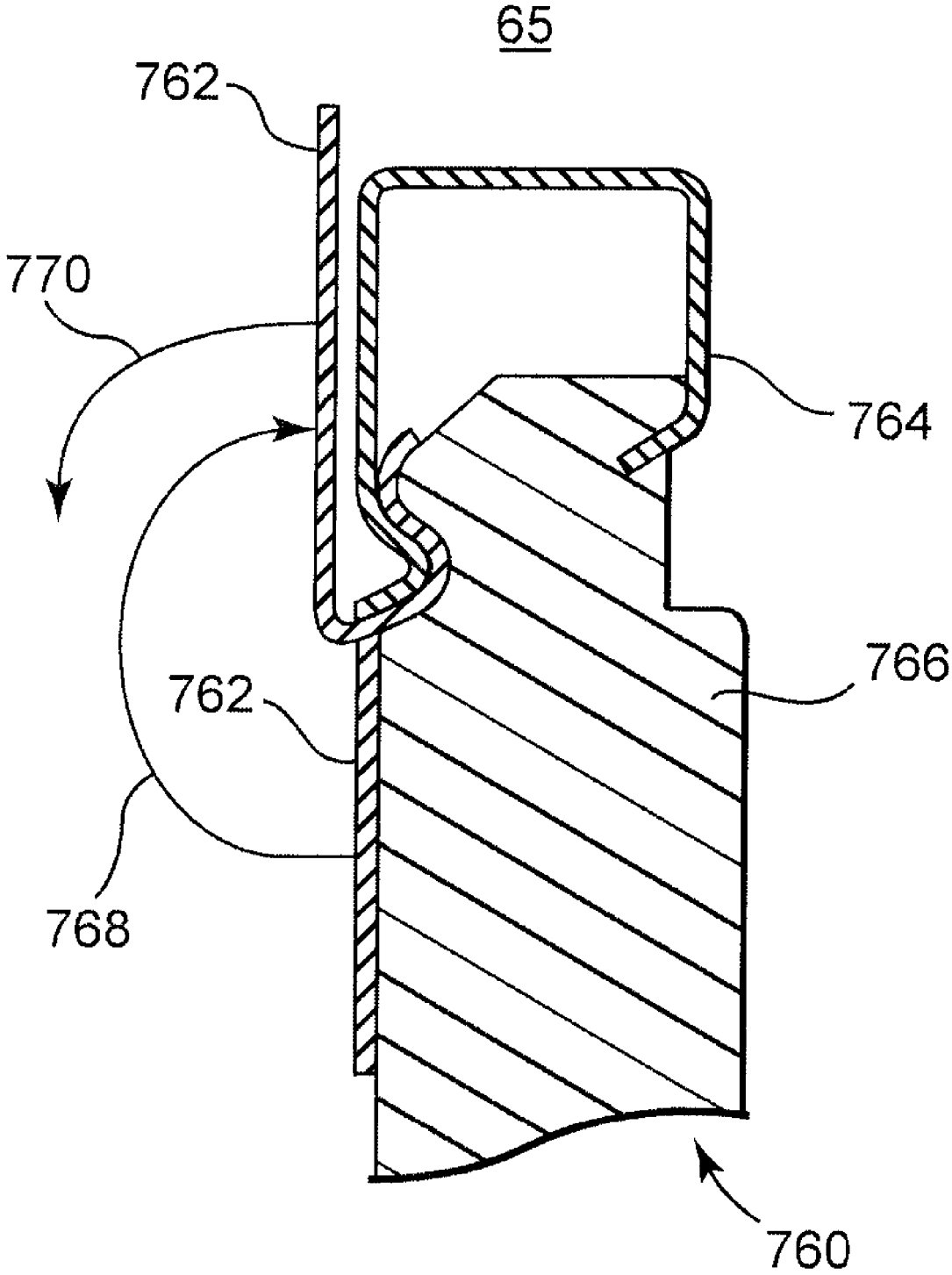
FIG. 3A is a sectional view taken along a horizontal axis of a closure assembly frame showing an alternate sealing member in accordance with one embodiment of the present invention.
Figure 3C:
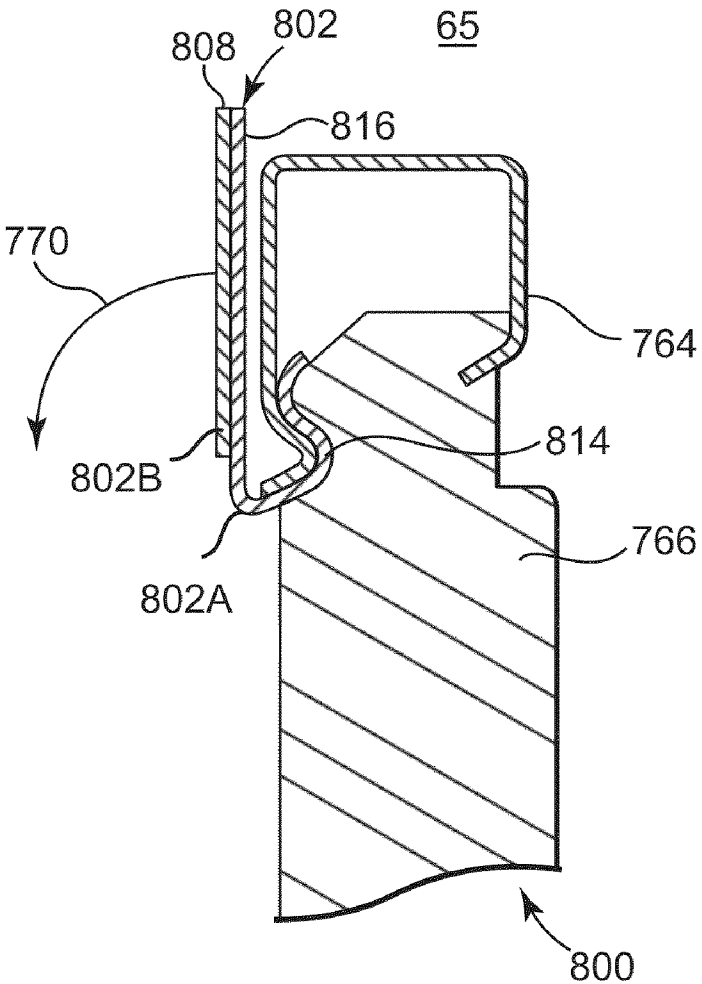
FIG. 3C is a section view of the closure assembly of FIG. 3B with the sealing member prepared to engage the rough opening in accordance with an embodiment of the present invention.

FIG. 3A illustrates an alternate closure assembly 760 with a flexible sealing member 762 captured between a metal cladding 764 and the frame 766 of the closure 760. The metal cladding 764 may be aluminum, and the frame 766 may be a wood jamb. In the illustrated embodiment, the sealing member 762 is a flexible gasket that preferably extends around the entire perimeter of the closure assembly 760. The sealing member 762 can be constructed from a variety of flexible polymeric materials, rubber, metal foil, and composites thereof. In one embodiment, the sealing member 762 includes an adhesive layer covered by a release liner (see FIG. 3B).

In one embodiment, the sealing member 762 is positioned against the frame 766 during shipping. Prior to installation, a distal edge of the sealing member 762 is positioned towards the exterior side 65 of the closure assembly 760. In the illustrated embodiment, the sealing member 762 is folded forward along arc 768 until it is adjacent to the aluminum cladding 764. Once the closure assembly 760 is positioned in the rough opening 20, the sealing member 762 is folded along arc 770 and attached to the structure 22 adjacent the rough opening 20. Positioning the sealing member 762 in the position 768 is particularly useful for installing the closure assembly 760 from the interior.

Figure 3B:
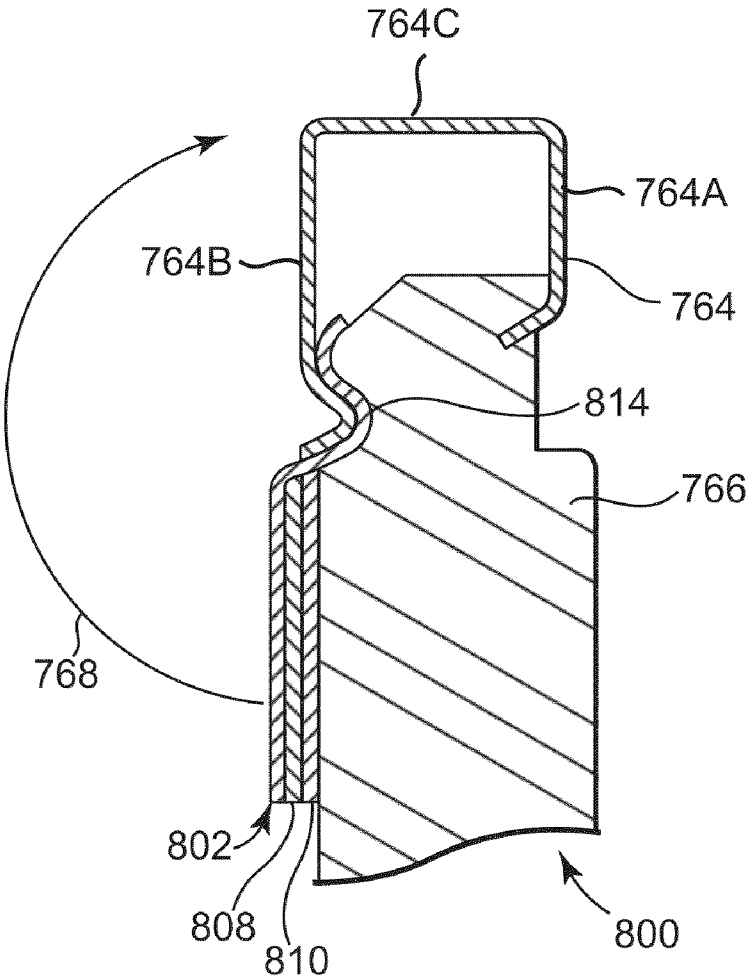
FIG. 3B is a sectional view taken along a horizontal axis of a closure assembly frame showing an alternate sealing member in accordance with one embodiment of the present invention.
Figure 3D:
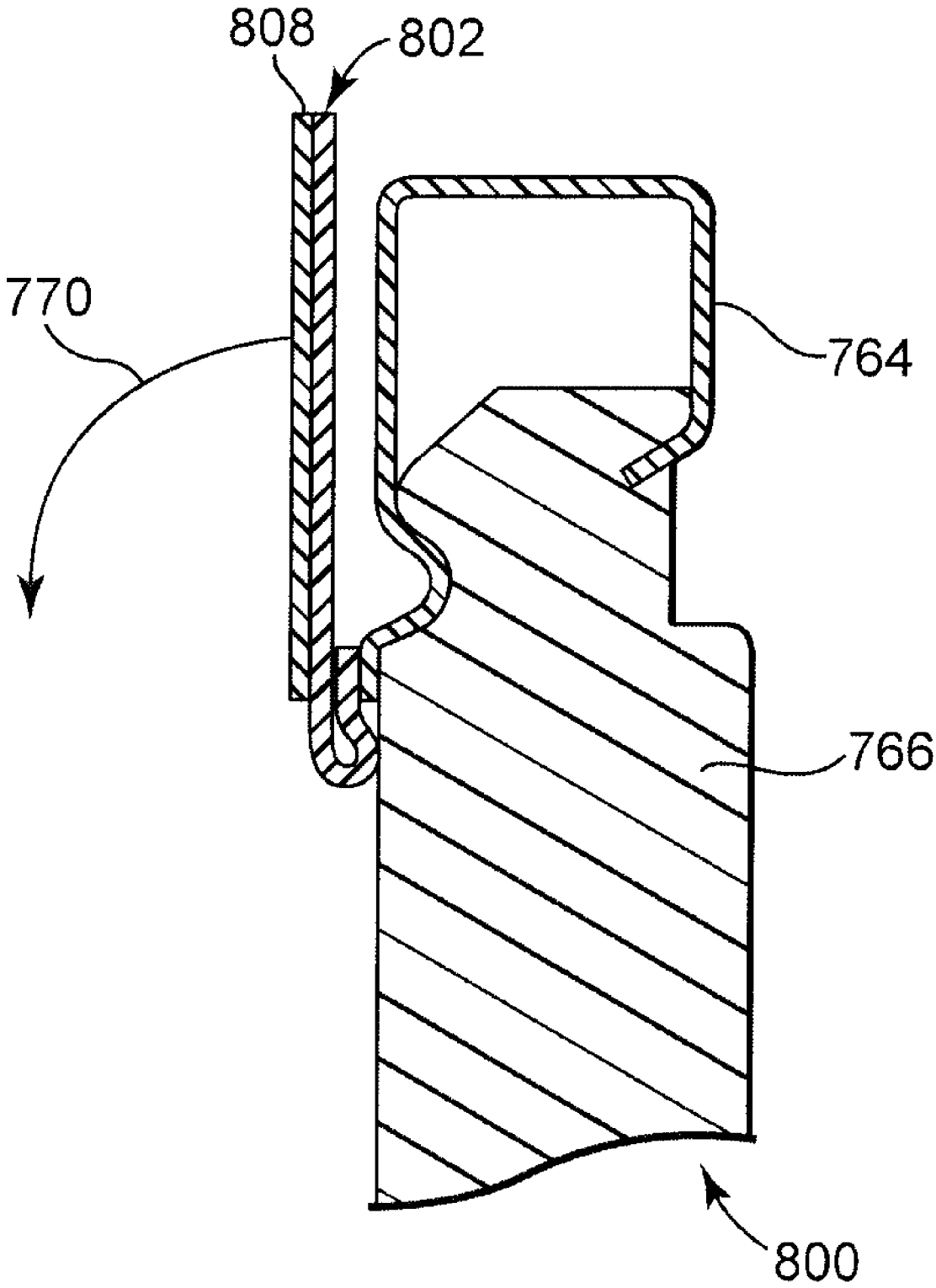
FIG. 3D is a section view of a closure assembly with a sealing member attached to cladding and/or a window frame in accordance with an embodiment of the present invention.

FIG. 3B illustrates an alternate closure assembly 800 with a flexible sealing member 802 captured between a metal cladding 764 and the frame 766. The seal formed between the sealing member 802 and the closure assembly 800 is subject to factory quality control standards. In the illustrated embodiment, the sealing member 802 is a segment of a flexible, water impermeable material that extends around, and is attached continuously to, the entire perimeter of the closure assembly 800. The sealing member 802 optionally includes an adhesive layer 808 covered by a release liner 810.

In the embodiment illustrated in FIG. 3C, the distal portions 802A of the sealing member 802 are positioned towards the exterior side 65 of the closure assembly 800 and the proximal portions 802B are received in the opening formed by the walls 764A, 764B, 764C of the aluminum cladding and captured between the aluminum cladding 764 and the frame 766. As shown, the distal portions 802A include release liner 810 and the proximal portions 802B are substantially free of any release liner. The sealing member 802 is folded forward along arc 768 until it is adjacent to the aluminum cladding 764. Once the closure assembly 800 is positioned in the rough opening 20, the release liner 810 is removed and the sealing member 802 is folded along arc 770 until the adhesive layer 808 is attached to the structure 22 adjacent the rough opening 20.

In the illustrated embodiment, portion 814 of the sealing member 802 is captured between the cladding 764 and the frame 766 around the entire perimeter of the closure assembly 800, including at the corners (see FIG. 1B). In one embodiment, the portion 814 that is captured between the cladding 764 and the frame 766 is molded from a rigid or semi-rigid material, optionally with a shape corresponding to the interface of the cladding 764 and the frame 766 and/or the profile of the frame 766. The portion 816 is optionally molded from a more flexible and durable material. In one embodiment, the portions 814 and 816 are discrete segments of material that are thermally bonded to form a water impermeable structure.

The rigid portion 814 facilitates handling of the sealing member 802 during assembly of the closure assembly 800. The rigidity of the portion 814 supports the flexible portion 816 and retains the sealing member 802 on the frame 766 while the cladding 764 is attached. In one embodiment, an adhesive or fastener is used to attach the portion 814 to the frame 766 before the cladding 764 is attached.

The sealing member 802 can be constructed from a variety of flexible materials, such a for example rubber, polymeric materials, metal foil, and composites thereof. In the illustrated embodiment, the sealing member 802 includes an adhesive layer 808 covered by a release liner 810 (see also FIG. 3B). The self-sealing embodiment permits the closure assembly 800 to be sealed to the rough opening 20 without additional products, such as for example flashing tape.

FIG. 3D illustrates an alternate closure assembly 760 with the flexible sealing member 802 adhesively attached to the metal cladding 764 and/or the frame 766 of the closure 800. Again, the seal formed between the sealing member 802 and the closure assembly 800 is subject to factory quality control standards. In the illustrated embodiment, the sealing member 802 is a segment of a flexible, water impermeable material that extends around, and is attached continuously to, the entire perimeter of the closure assembly 800. The sealing member 802 optionally includes an adhesive layer 808 covered by a release liner 810 (see FIG. 3B). Once the closure assembly 760 is positioned in the rough opening, the sealing member 802 is rotated along arc 770 into engagement with the structure.

Figure 3E:
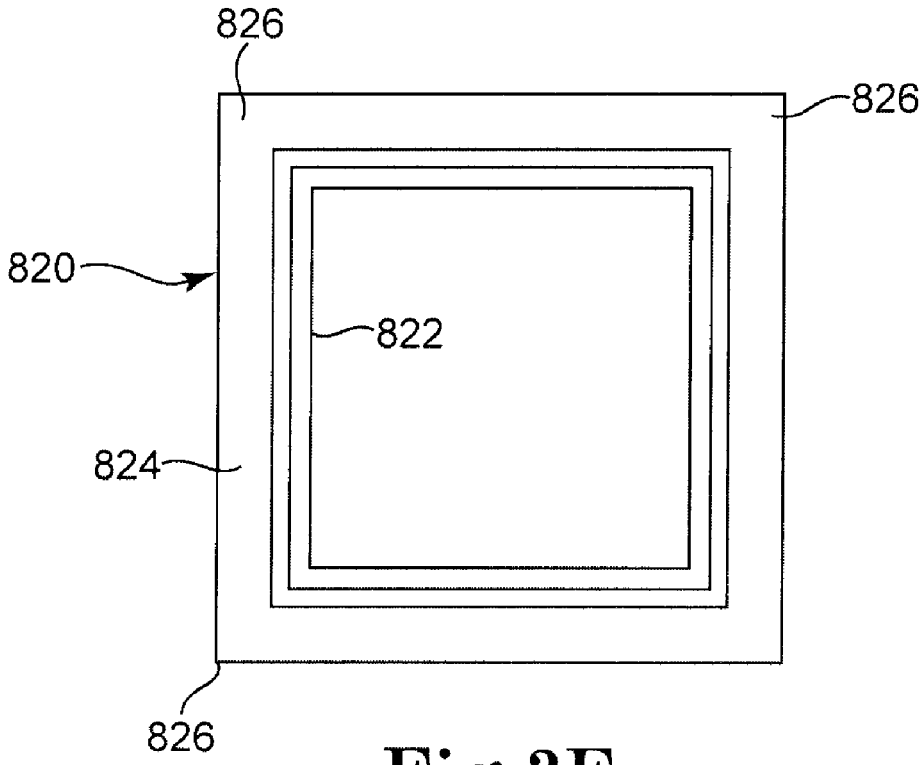
FIG. 3E is a front view of a pre-formed sealing member in accordance with an embodiment of the present invention.

FIG. 3E illustrate an embodiment of the sealing member 820 formed as an injection molded or thermally formed component. These embodiments may be homogeneous or formed from multiple layers of different materials. In one embodiment, the inner portion 822 that is attached to the closure assembly is rigid or semi-rigid and the outer portion 824 is flexible.

The inner portion 822 is preferably formed with a contour that corresponds to the shape of the wood frame at the location of attachment. The corners 826 can be precisely formed, without the deformation that occurs when bending a linear section around a corner. This embodiment of the sealing member 820 can also be manufactured in high volumes at low cost. The difficulty is that closure assemblies are manufactured in a large number of sizes and shapes, requiring considerable inventory of the sealing member 820.

Figure 3F:
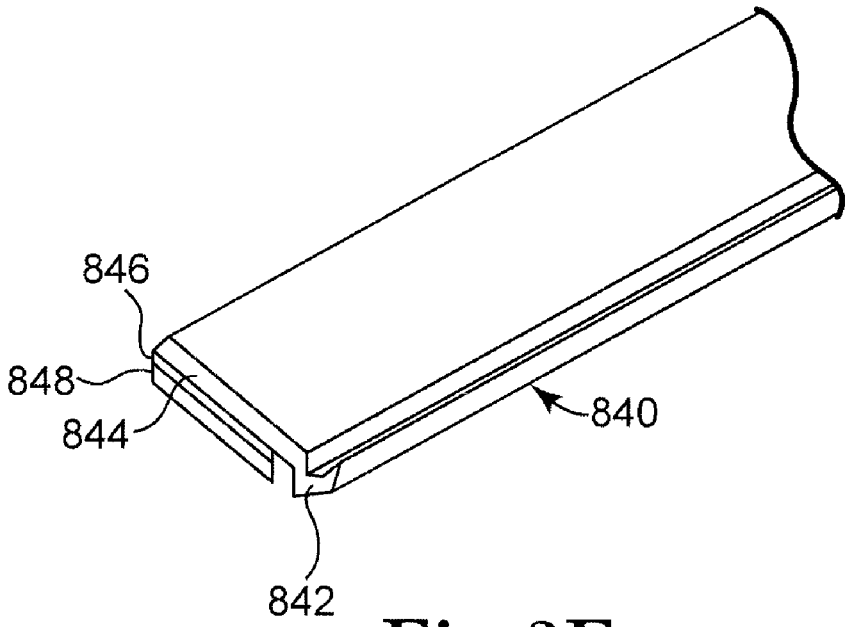
FIG. 3F is a perspective view of a sealing member formed as a lineal in accordance with an embodiment of the present invention.

FIG. 3F illustrates an alternate embodiment of the sealing member 840 manufactured as a lineal. In one embodiment, the inner portion 842 and the outer portion 844 are co-extruded from different materials. The inner portion 842 is optionally shaped to be captured between the frame 766 and the cladding 764. In an alternate embodiment, the sealing member 840 is attached to a closure assembly using adhesives, fasteners, or a combination thereof.

The closure assembly 840 is preferably formed to the shape and size of the closure assembly in a separate processing step, such as for example using heat and pressure to thermally deform the corners. Adhesive layer 846 and release liner 848 can optionally be added to the outer portion 844 either before or after the processing step.

Figure 4:
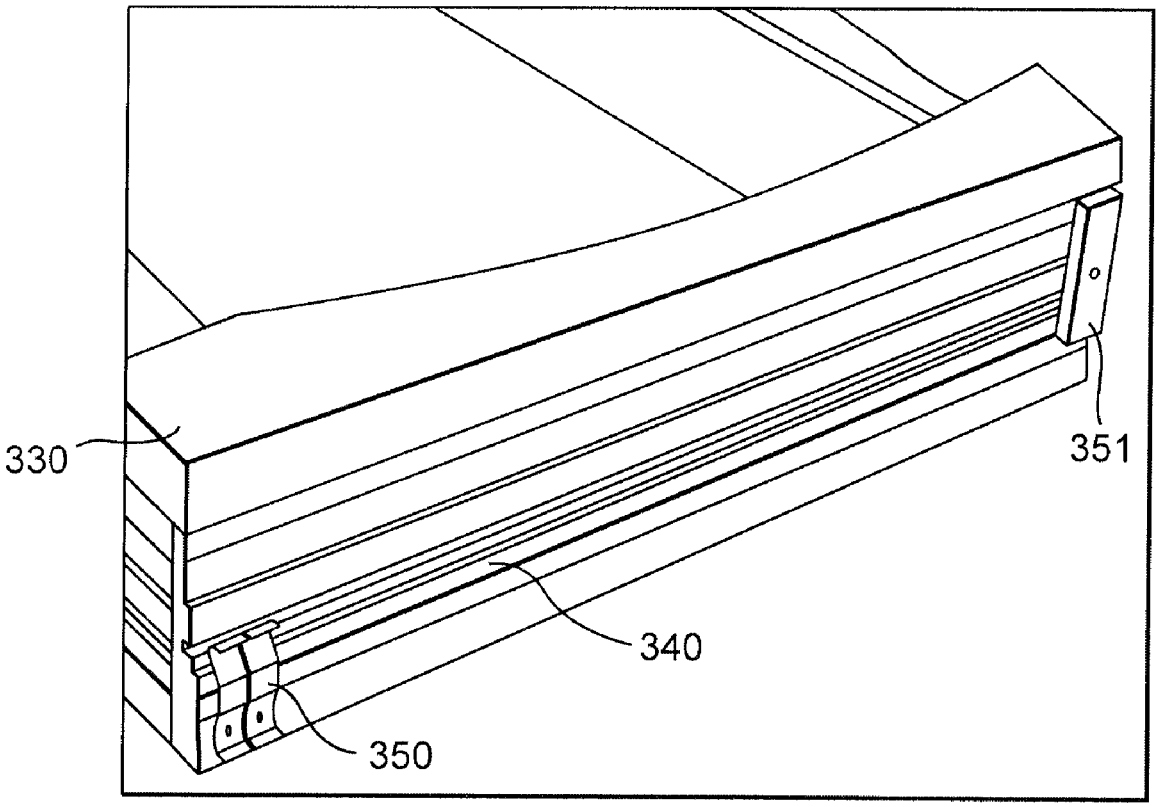
FIG. 4 is a schematic view of a portion of a closure assembly detailing a shim arrangement in accordance with one embodiment of the present invention.

FIG. 4 shows a bottom view of the closure assembly 330 of FIG. 2. The closure assembly 330 may include one or more adjustable shims 350 for use in verifying that the closure assembly 330 is accurately positioned within the rough opening 20. In the preferred embodiment, the adjustable shims 350 are releasably attached to the closure assembly 330 at a location remote from the rough opening 20, such as a manufacturing facility.

The closure assembly 330 is preferably packaged and shipped with the adjustable shims 350 pre-attached. Alternatively, some or all of the adjustable shims 350 can be snap-fit into the longitudinal recess 340 at the installation site. The adjustable shims 350 can preferably be attached and detached from the recess 340 without the use of tools. In one embodiment, the adjustable shims 350 are adapted to form a snap-fit relationship with the longitudinal recess 340. In another embodiment, one or more fixed or block shims 351 may be used in combination with the adjustable shim 350 to form a more complex shim arrangement. The block shims 351 establish a minimum gap between the closure assembly 330 and the sill of the rough opening. The adjustable shim 350 permits the closure assembly 330 to be leveled relative to the block shim 351.

Figure 5:
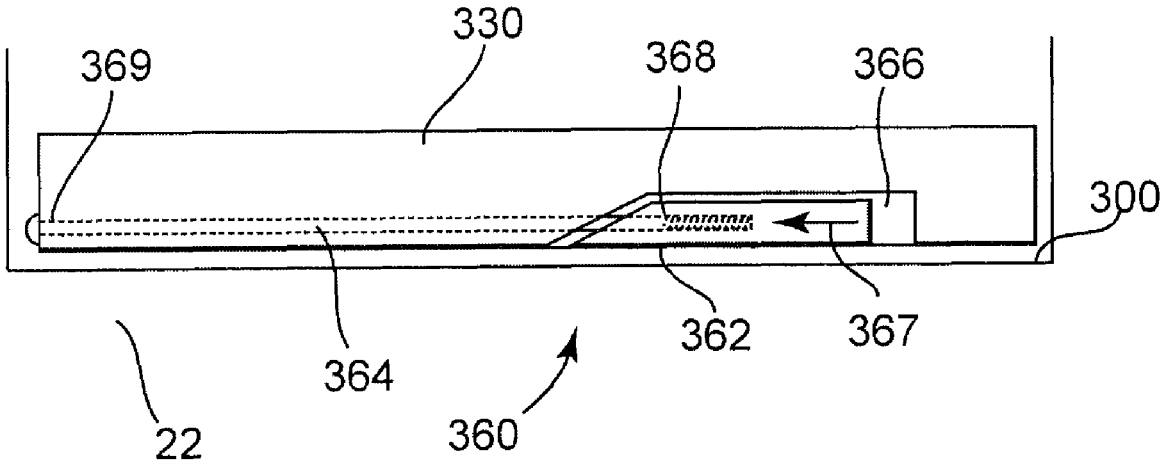
FIG. 5 is an end view of an adjustable shim for use with a closure assembly in accordance with one embodiment of the present invention.

FIG. 5 illustrates one embodiment of an adjustable shim 360 that may be used to verify that the closure assembly 330 is accurately positioned within the rough opening 20. Shim 360 includes a wedge member 362 and a screw 364. The wedge member 360 is received in a wedge-shaped pocket 366 in the closure assembly frame. The screw 364 is rotatably coupled to the wedge member 362 at a traveling end 368 and has a driving end 369 that is accessible at a perimeter of the closure assembly 330. As the screw 364 is torqued at the driving end, the wedge member 362 travels along the driving end 369 of the screw 364 within the pocket 366 as indicated by arrow 367. As the wedge member 362 travels horizontally along the angled portion of the pocket 366, the closure assembly 330 moves in a vertical direction. The shim 360 may be adjusted to accurately position the closure assembly 330, for example by leveling the closure assembly 330 or by centering the closure assembly 330 within the rough opening 20.

Figure 6:
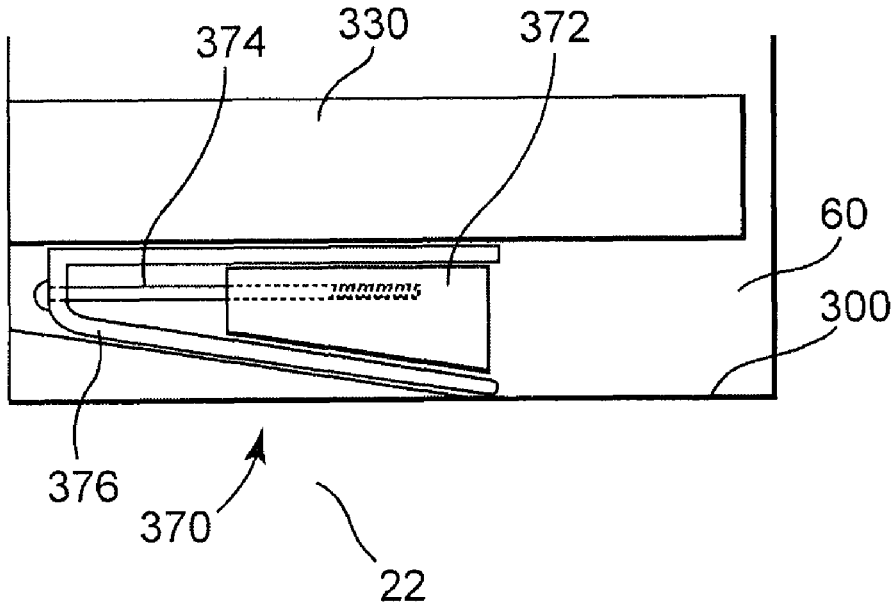
FIG. 6 is an end view of an adjustable shim for use with a closure assembly in accordance with one embodiment of the present invention.

FIG. 6 illustrates another embodiment of an adjustable shim 370 that may be used to verify that the closure assembly 330 is accurately positioned within the rough opening 20. Adjustable shim 370 includes a wedge member 372 and a screw 374. Adjustable shim 370 is generally similar to adjustable shim 360 as described with respect to the embodiment shown in FIG. 5 and is operated in a similar manner. However, rather than being received in a pocket in the closure assembly frame, shim 370 is received in a wedge-shaped receiving member 376 located in a gap 60 between the closure assembly 330 and the sill surface 30D of the rough opening 20. This embodiment does not require that the closure assembly frame be modified to include the pocket 366 as shown in FIG. 5. Rather, the adjustable shim 370 is separate and may be added to any closure frame.

Figure 7:
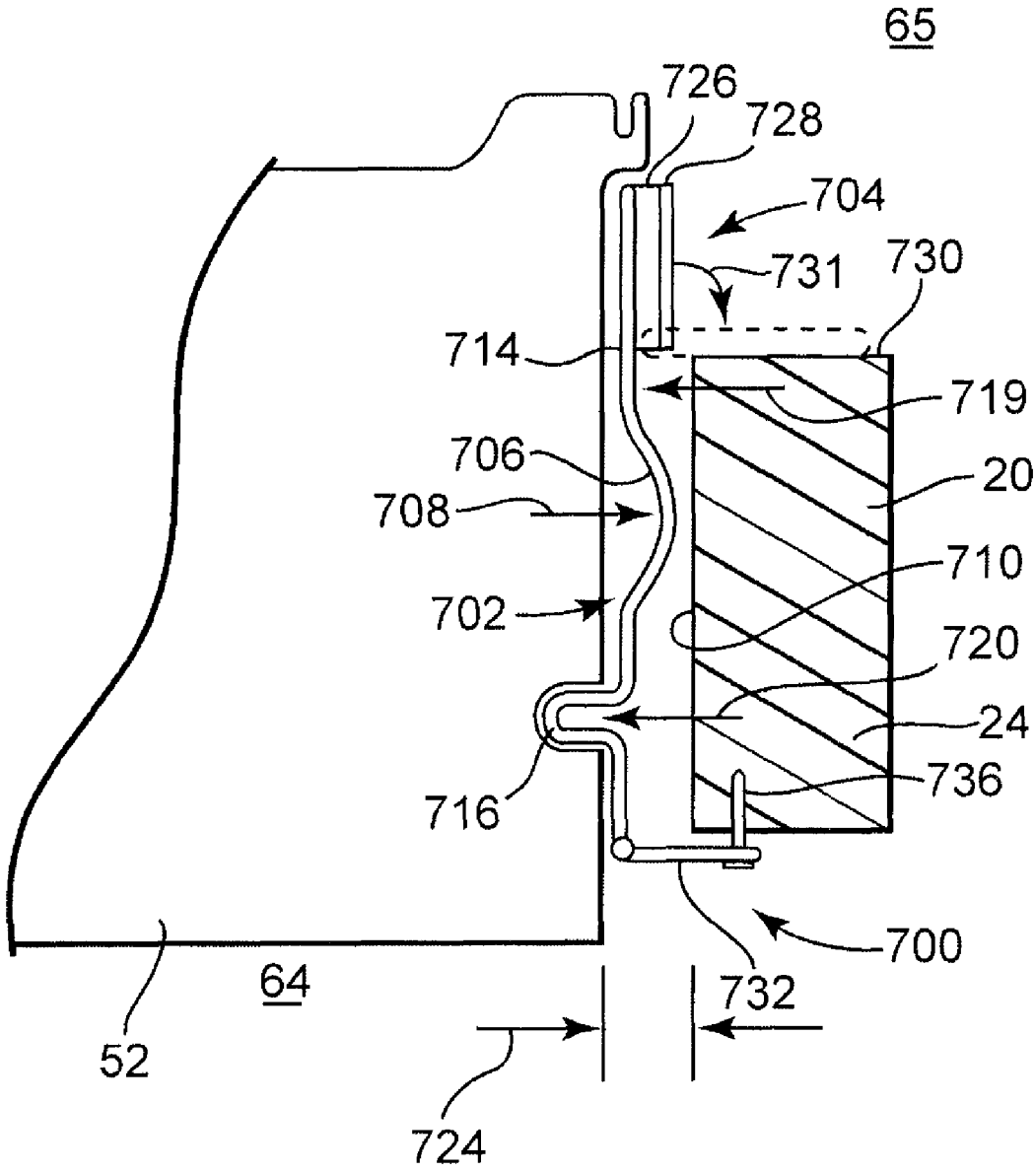
FIG. 7 is a sectional view taken along a horizontal axis of a constant pressure shim in accordance with one embodiment of the present invention.

FIG. 7 illustrates an alternate shim system 700 in accordance with the present invention. Alternate shim system 700 is described in reference to closure assembly 52, but may be used with any closure assembly described herein. In the illustrated embodiment, a constant pressure shim 702 is combined with sealing member 704. The shim system 700 is preferably constructed from a resilient material, such as for example metal or plastic, that is capable of substantially returning to an original shape or position after having been compressed. In the illustrated embodiment, the sealing member 704 is integrally formed from the same material used to construct the constant pressure shim 702. In an alternate embodiment, the constant pressure shim 702 and the sealing member 704 can be constructed from different materials.

The constant pressure shim 702 includes spring portion 706 that applies force 708 against an interior surface 710 of the frame member 24 defining the rough opening 20. Portions 716, 724 apply forces 719, 720 against the closure assembly 52. In the illustrated embodiment, portion 716 is attached to the closure assembly 52. Force 708 and the forces 719, 720 generated by the spring portion 706 are balanced to maintain a gap 724 between the closure assembly 52 and the interior surface 710. When multiple constant pressure shims 702 are positioned around the perimeter of the closure assembly 52, the forces 708, 719, 720 may be used to accurately position the closure assembly 52 in the rough opening 20.

In the illustrated embodiment, the sealing member 704 includes an adhesive layer 726 covered by a release liner 728. During installation of the closure assembly 52, the release liner 728 is removed and the sealing member 704 is folded as shown by arrow 731 so that the adhesive layer 726 bonds to a surface 730 on the exterior side 65 of the structure.

The alternate shim system 700 optionally includes a stop 732 that limits how far the closure assembly 52 is inserted in the rough opening 20. The stop 732 is preferably integrally formed from the same material as the constant pressure shim 702 and the sealing member 704. In the illustrated embodiment, the stop 732 is located near the interior side 64 of the closure 52. Consequently, the closure assembly 52 is preferably inserted from the interior side 64 of the rough opening 20. In one embodiment, the stop 732 is used to secure the closure assembly 52 in the rough opening 20, such as by securing the constant pressure shim 702 to the frame member 24 with fastener 736.

Figure 8:
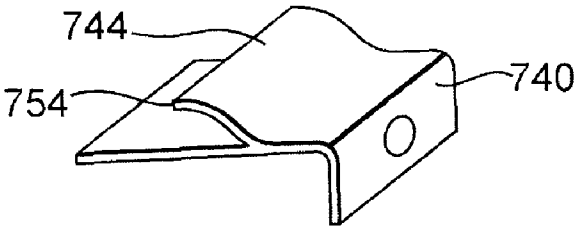
FIG. 8 is an alternate constant pressure shim in accordance with one embodiment of the present invention.
Figure 9:
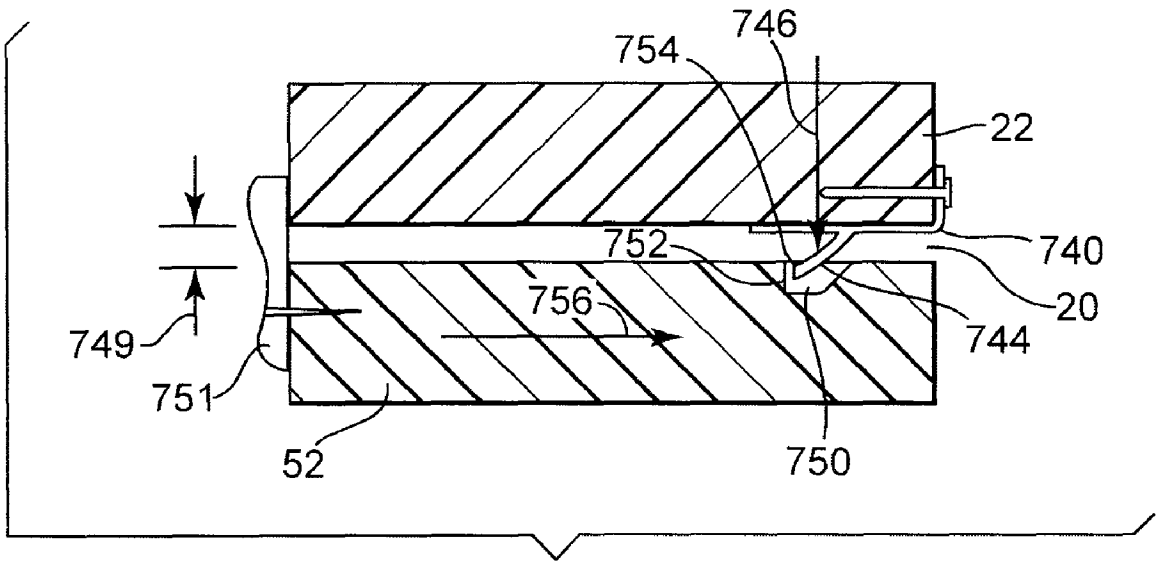
FIG. 9 is a sectional view of the constant pressure shim of FIG. 8 engaged with a closure assembly.

FIGS. 8 and 9 illustrate an alternate constant pressure shim 740 in accordance with an embodiment of the present invention. Again, constant pressure shim 740 is described in reference to closure assembly 52, but may be used with any closure assembly described herein. The constant pressure shim 740 is approximately L-shaped and has a spring portion 744. As illustrated in FIG. 9, the constant pressure shim 740 is optionally attached to the structure 22 adjacent the rough opening 20. Spring portion 744 applies force 746 on the closure assembly 52 to maintain gap 749.

The closure assembly 52 optionally includes a groove 750 having a surface 752 that engages with a distal end 754 of the spring portion 744. Once engaged, the distal end 754 prevents the closure assembly 52 from being displaced in direction 756. The spring portion 744 also serves to position the closure assembly 52 in the rough opening 20. In one embodiment, the constant pressure shim 740 is used only to position and secure the closure assembly 52 in the rough opening 20.

For interior installation applications, the embodiment of FIGS. 8 and 9 is particularly suited for installing a closure assembly with finish trim 751 pre-installed, preferably at the remote location. This embodiments permits the finish trim 751 to be factory installed and factory finished prior to the closure assembly 52 being shipped to the installation site. Various additional shims and factory installed finish trim are described in U.S. patent application Ser. No. 11/089,847, entitled Installation Method and System for a Closure Unit, which is hereby incorporated by reference.

Figure 10:
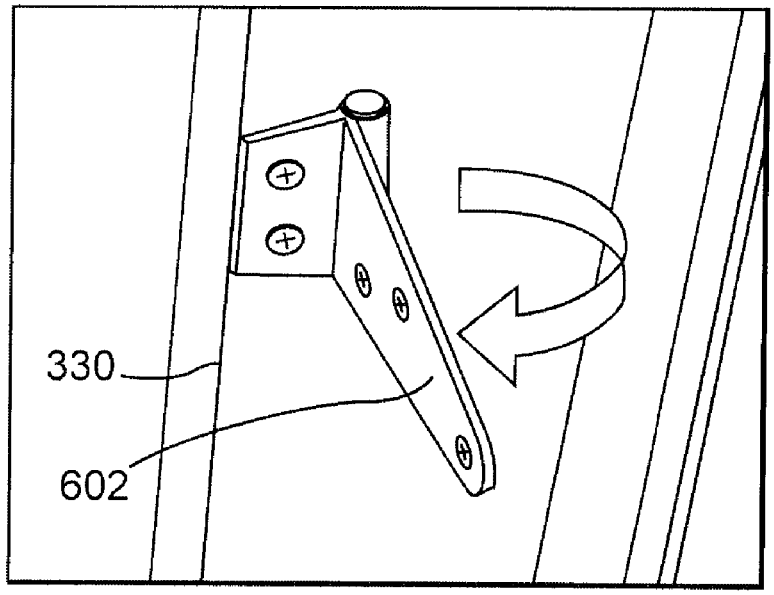
FIG. 10 is a schematic view of a securing member for use with a closure assembly in accordance with one embodiment of the present invention.
Figure 11:
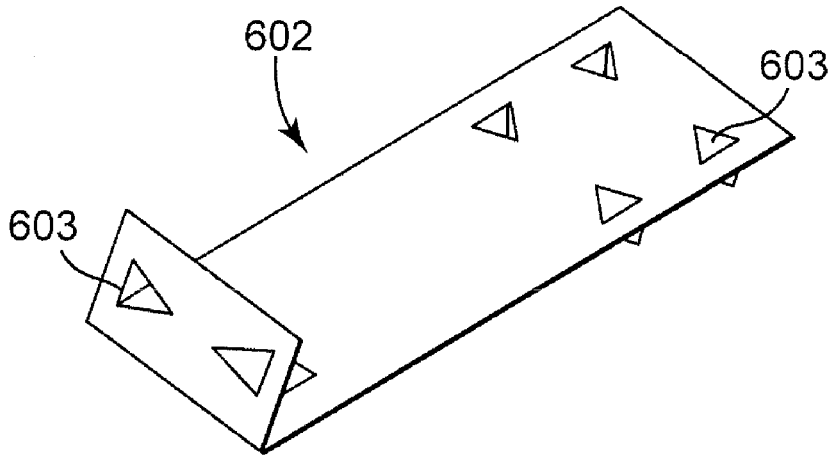
FIG. 11 is a schematic view of an alternate securing member for use with a closure assembly in accordance with one embodiment of the present invention.

A closure assembly, such as for example the closure assembly 330, optionally includes one or more securing members 602, shown in FIG. 10. The securing members 602 may have a variety of configurations. For example, the securing members 602 may be brackets and may include through holes for receives screws or nails, as illustrated in FIG. 10. In other embodiments, the securing members 602 may include preformed barbs 603 that can be tapped into the structure 22 surrounding the rough opening 20 (See FIG. 11). In still other embodiments, the securing members may include an adhesive to effect securing.

Securing members 602 are employed to provide convenient securing of the closure assembly 330 within the rough opening 20 during installation. The securing members 602 are preferably attached to the closure assembly 330 at location remote from the rough opening 20 prior to installation of the closure assembly 330, such as a manufacturing factory. This embodiment permits the securing members 602 to be factory installed prior to the closure assembly 330 being shipped to the installation site. In other embodiments, however, the securing member(s) 602 are attached to the closure assembly 330 at the installation site.

The securing members 602 are preferably mounted proximate an interior portion of the closure assembly 330. In the embodiment of FIG. 10 the securing members 602 are mounted on the closure assembly 330 in a shipping position that is folded or retracted for ease of packaging and shipping. The securing members 602 are deployable from the shipping position to insertion and/or attachment positions at the installation site for use, as shown by arrow 604. In one embodiment, the securing member 602 is a hinge structure. In some embodiments, the shipping position and the insertion position are the same, or the insertion position and the attachment position are the same.

In other embodiments, the securing member 602 does not change position. In one embodiment, in the insertion position, the securing member 602 extends from the perimeter of the closure assembly 330 in the interior plane of the closure assembly 330. In this position, the securing member 602 may function as a stop, preventing over insertion of the closure assembly 330 from the interior side 64 of the structure 22. In other embodiments, a separate accessory carried on the closure assembly 330 may function as a stop for installation from either the exterior side 65 or the interior side 64 of the structure 22.

Figure 12:
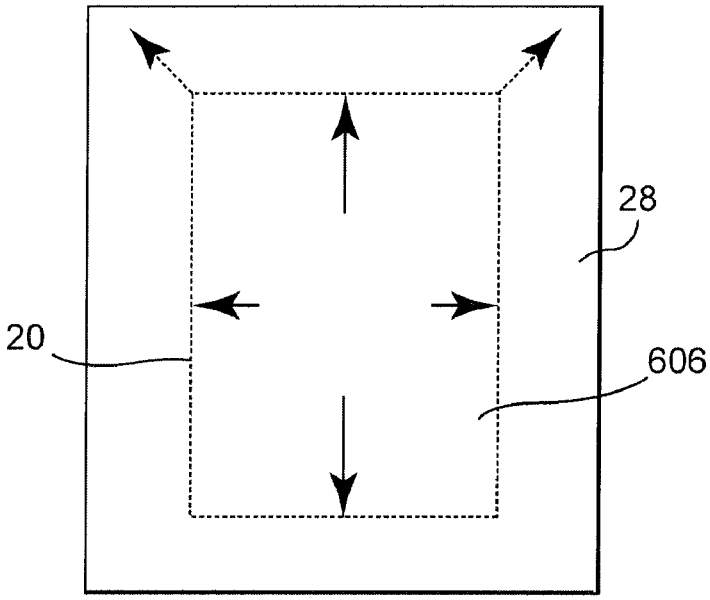
FIG. 12 is a schematic illustration of cut lines for forming an insertion opening in a moisture barrier in accordance with one embodiment of the present invention.
Figure 13:
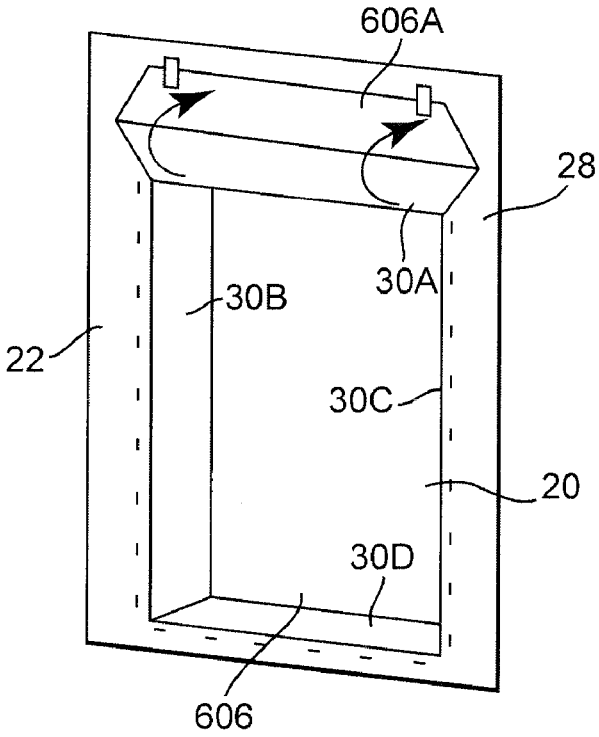
FIG. 13 is a schematic illustration of an arrangement of a moisture barrier flaps about a rough opening in accordance with one embodiment of the present invention.

Any of the closure assembly described herein may be installed in the rough opening 20 as shown in FIGS. 12-21. First, an insertion opening 606 is cut into the water resistant barrier 28 generally corresponding to a perimeter of the rough opening 20, as shown in FIG. 12. A header flap 606A is cut in the water resistant barrier 28 and is folded away from the rough opening 20. The header flap 606A is temporarily fixed to the water resistant barrier 28 above the header surface 30A of the rough opening 20 as shown in FIG. 13.

A flashing member 608 is preferably applied over the jamb surface 30*d*. The flashing member 608 may be a foil backed flashing tape. Preferably, the flashing member 608 is longer than the length of the sill surface 30*d* so that the ends of the flashing member 608 extend up the jambs surfaces 30*b* and 30*c* (30*c* not visible) as well. The flashing member 608 is positioned partially forward of the plane of the rough opening 20 so that a portion of the flashing member 608 is located on the sill surface 30*d* and a portion of the flashing member 608 extends to the exterior side 65 of the structure 22.

Figure 14:
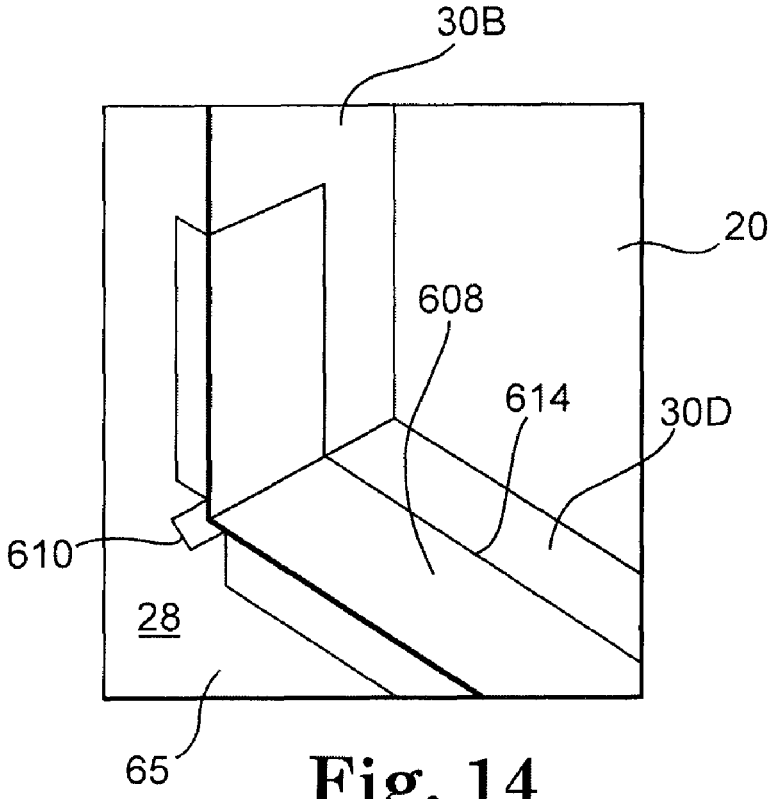
FIG. 14 is a schematic illustration of a sealing member on a sill surface in accordance with one embodiment of the present invention.
Figure 15:
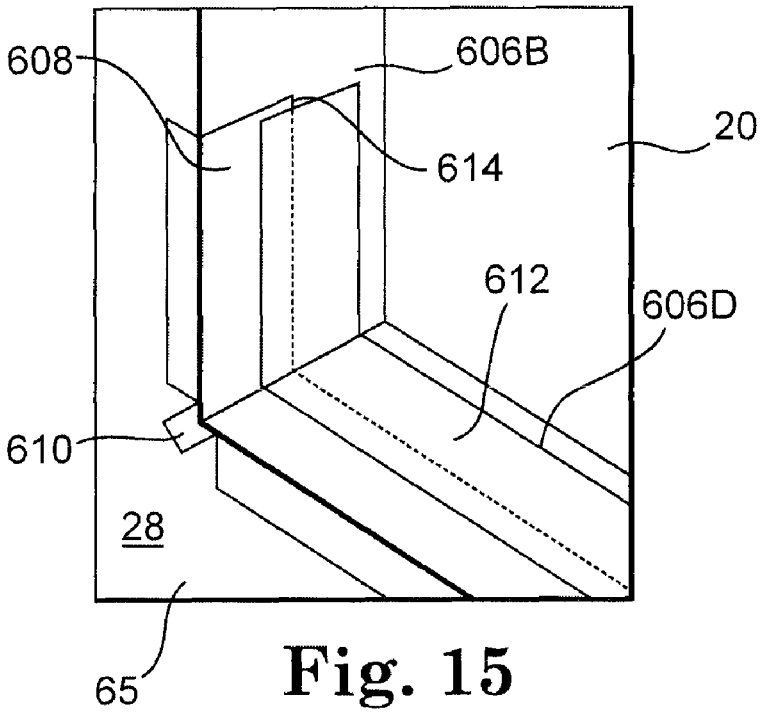
FIG. 15 is a schematic illustration of a second sealing member on a sill surface in accordance with one embodiment of the present invention.

The exterior portion of the flashing member 608 is folded down and away from the rough opening 20 over the water resistant barrier 28. As shown in FIG. 14, tabs 610 may be cut into the flashing member 608 at the corners of the rough opening 20 so that the flashing member 608 is folded flat onto the water resistant barrier 28 below the rough opening 20. FIG. 15 illustrates an optional second flashing member 612 applied overlapping an interior edge 614 of the flashing member 608.

The preceding steps prepare the rough opening 20 to receive a closure assembly. Any of the closure assembly discussed above may be combined with other features disclosed herein, including for example the adjustable shims, securing members, sealing members, and the like. The closure assembly can be installed from either the exterior or interior.

In one embodiment of the present invention, as shown in FIG. 1, a drainage system 32 is optionally installed in the rough opening 20 for draining collected moisture away from the closure assembly 52 to a drainage area. Various embodiments of the drainage system 32 and methods of installation are described in U.S. patent application Ser. No. 11/340,253, entitled High Performance Window and Door Installation, which is hereby incorporated herein by reference.

Figure 16:
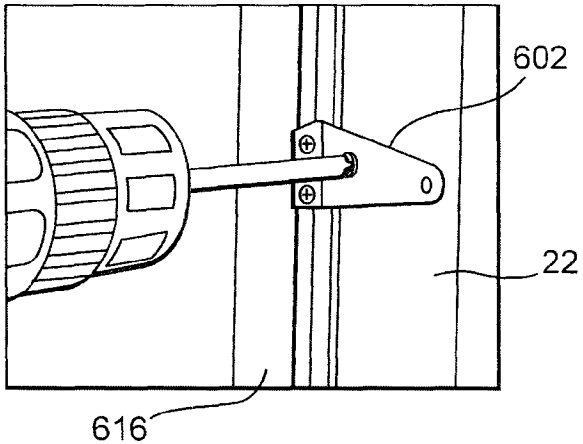
FIG. 16 is a schematic illustration detailing attaching securing members to a rough opening in accordance with one embodiment of the present invention.

In one embodiment, the closure assembly is installed into the rough opening 20 from the interior side 64 of the structure 22. Where the securing member 602 are pre-installed on the closure assembly 52, the securing members 602 are folded from the shipping position to the installation position as illustrated in FIG. 16. The closure assembly 616 is then placed in the rough opening 20, care being taken not to dislodge the drainage system (if installed). The closure assembly may be inserted into the rough opening 20 until a stop structure, such as the securing member 602, engages the structure 22 (see FIG. 16). In other embodiments, however, the closure assembly is installed into the rough opening 20 from the exterior side 65 of the structure 22.

The position of the securing member 602 in the installation position may be chosen such that the interior plane of the closure assembly 616 is flush or at a pre-selected position relative to the interior plane of the structure 22. In this manner, over insertion of the closure assembly may be reduced. This may also function as a safety feature, aiding in preventing the closure assembly from falling through the rough opening 20. Furthermore, the stop may provide a quick and easy method of aligning the interior plane of the closure assembly 616 with the interior plane of the structure 22.

Figure 17:
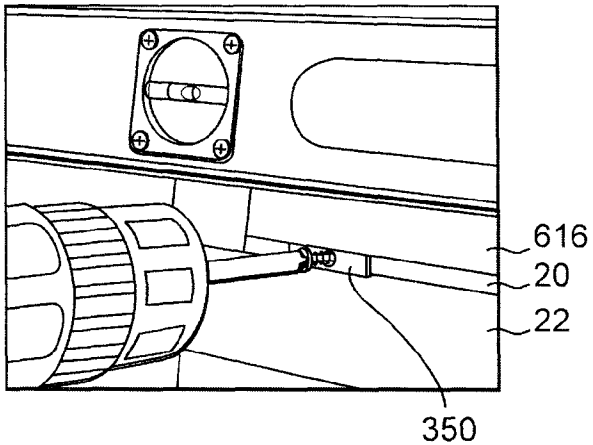
FIG. 17 is a schematic illustration detailing positioning a closure assembly within a rough opening in accordance with one embodiment of the present invention.

The closure assembly 52 is then accurately positioned within the rough opening 20. This step may entail making adjustments to the position of the closure assembly, as shown in FIG. 17, so that the closure assembly is level or centered within the rough opening 20. In one embodiment, one or more shims 350 are carried on the closure assembly. The number and location of shims 350 can vary depending upon the application. The height or displacement of the shim may be adjusted to level the closure assembly.

In other embodiments, shims are inserted between closure frame and either or both of the sill surface 30D or jamb surface 30B, 30C (not shown). A combination of adjustable shims, block or wedge shims, or constant pressure shims may be used to accurately position the closure assembly within the rough opening. This step may further include adjusting the position of a shim relative to the closure assembly, for example, by sliding the shim along the frame to a selected location for engaging the structure 22.

The closure assembly is then secured in the rough opening 20 by engaging the securing member 602 with an interior surface of the rough opening 20. The securing member 602 may be deployed or opened from the insertion position to the attachment position for engaging the interior portion of the rough opening 20. The securing members 602 are attached to the structure 22 to hold the closure assembly 52 in place, as shown in FIG. 16. This step may entail screwing or nailing driving members through the securing members 602 and into the structure 22. Alternately, according to the configuration of the securing members 602, barbs 603, for example, can be tapped into the structure 22 to secure the closure assembly 52 (See FIG. 11).

Figure 20:
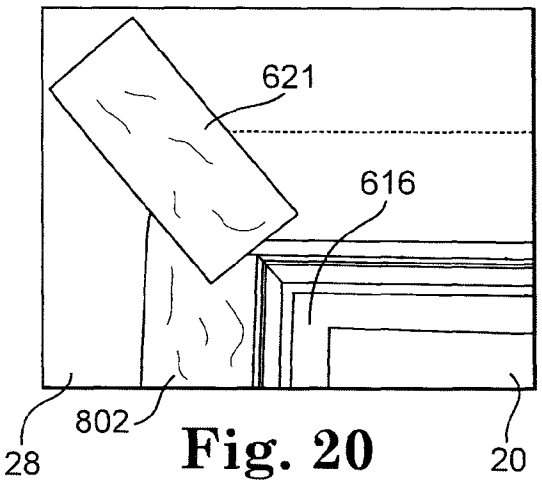
FIG. 20 is a schematic illustration of sealing ends of a header flap to a moisture barrier in accordance with one embodiment of the present invention.
Figure 19:
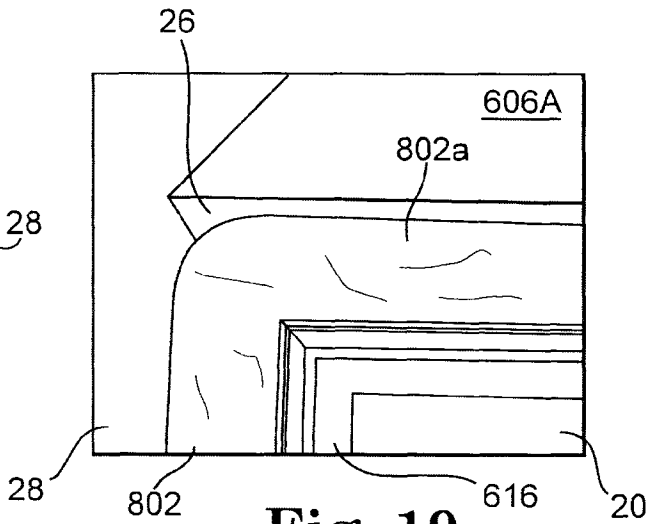
FIG. 19 is a schematic illustration of a watershed configuration with sealing members over a header of a rough opening in accordance with one embodiment of the present invention.
Figure 18:
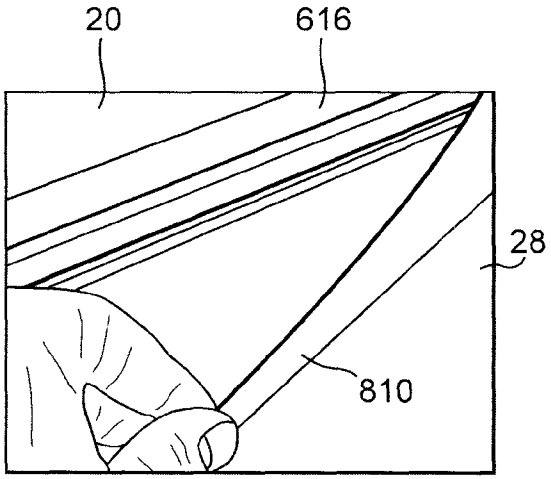
FIG. 18 is a schematic illustration attaching a sealing member carried on a closure assembly to a structure in accordance with one embodiment of the present invention.

FIGS. 18-20 are directed to the continuous sealing member 802 embodiment illustrated in FIGS. 1B and 1C, although FIGS. 18-20 are equally applicable to any of the closure assemblies and sealing members disclosed herein.

As illustrated in FIG. 18, the release liner 810 is removed from the sealing members 802 to expose the adhesive layer 808. In one embodiment, sealing members 802 carried on the exterior perimeter of the closure assembly are adhered to the water resistant barrier 28 surrounding the rough opening 20.

Referring now to FIG. 19, sealing members 802 attached to the closure assembly are engaged with the structure 22 on the exterior side proximate the rough opening 20 to form a seal around the exterior perimeter of the closure assembly, thus preventing the ingress of moisture into the structure 22 (see FIG. 1).

In one embodiment, the upper portion 802A of the sealing member 802 is adhered to the sheathing 26 at the top of the rough opening 20, the header flap 606A having been previously folded away from the rough opening 20. The header flap 606A is then folded down to overlap the header sealing member 300*a*. This configuration provides a watershed arrangement whereby moisture is diverted to the exterior side of the closure assembly. The side portions and lower portion of the sealing member 802 are preferably attached to the water resistant barrier 28.

As shown in FIG. 20, flashing or other flashing tape 621 is optionally applied over the ends of the header flap 606*a* to seal the ends of the header flap 606*a* to the moisture barrier 28 and the sealing member 802. In general, flashing tape 621 is applied in alignment with the angle of the ends of the header flap 606*a*. Thus, in one embodiment, as shown in FIG. 20, the flashing tape 621 is applied at a 45° angle to cover the ends of the header flap 606*a*. Optionally, flashing is applied over the long edge of the header flap 606A to seal the header flap 606*a* to the upper portion 802A (not shown). Flashing tape 621 may be a foil backed butyl tape or other flashing, similar to the flashing applied to the water resistant barrier 28 at the sill member 30D.

Figure 21:
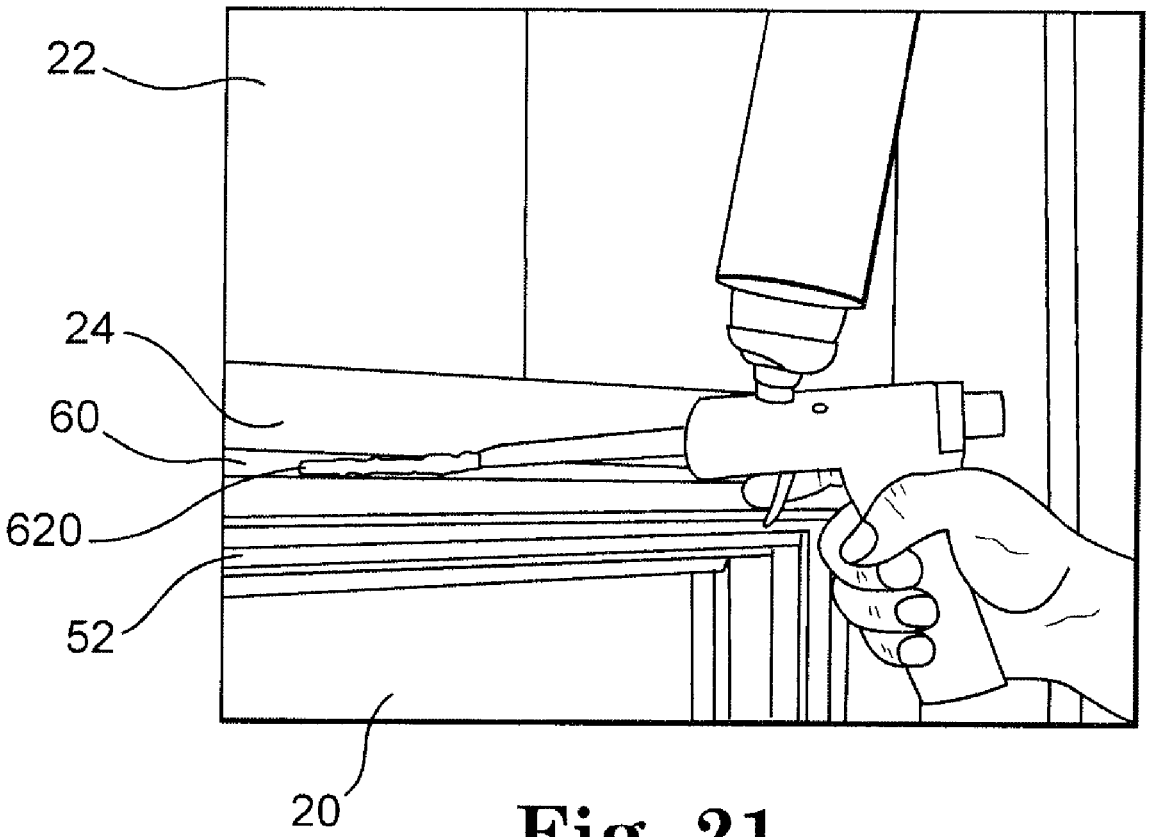
FIG. 21 is a schematic illustration detailing the step of delivering a foam material into a gap between a closure assembly and a rough opening in accordance with one embodiment of the present invention.

In the embodiment illustrated in FIG. 21, a curable foam material 620 is delivered into the gap 60 between the boundaries of the rough opening 20 and the closure assembly 52. The curable foam material provides an excellent seal and can optionally serve as the primary structural attachment of the closure assembly to the structure 22. The foam material 620 is delivered into the gap 60 with an injection gun as shown in FIG. 21. The foam is delivered into the gap 60 so as to form an attachment directly to the framing members surrounding the rough opening 20.

As used herein, "primary structural attachment" refers to a mechanism that provides at least 50% of an attachment force that resists separation of the closure assembly 616 from the framing members 24 or composite panel along a direction generally perpendicular to a major surface of the structure 22. That is, the shear characteristics of the foam material 620 are substantially greater than the anticipated force F. In the preferred embodiment, the cured foam material 620 preferably provides about 70%, and more preferably about 80%, and most preferably about 95%, of the attachment force.

In another embodiment, the substantially cured foam material 620 provides the sole structural attachment between the closure assembly 52 and the framing members 24 or composite panel. As used herein, "sole structural attachment" refers to a mechanism that provides 100% of an attachment force that resists separation of a closure assembly 616 from the structure 22 along a direction generally perpendicular to a major surface of the structure 22, excluding any attachment force provided by the securing members 602, fins (not shown) or the sealing arrangement.

In another embodiment, nails, screws or bolts are driven through a portion of the closure assembly 616 into the structure 22. When the closure assembly 52 is secured to the structure 22, a different method of preparing the rough opening 20 to receive the closure assembly 52 may be employed. Rather than cutting the water resistant barrier 28 to correspond to the rough opening 20, the flaps 606A-D of water resistant barrier 28 are formed at the header, sill and jamb members 30A-D. The sill and jamb flaps 606B-D are folded toward the inside of the rough opening 20 so that they cover the sill and jamb surfaces 30B-30D of the rough opening 20. The sill and jamb flaps 606B-D are affixed to the structure 22, for example by stapling or adhering. In one embodiment, the ends of the flaps 606A-D are cut at approximately a 45° angle.

This configuration permits the flaps 606A-D to be folded inwardly without wrinkling the material of the moisture barrier 28. Flashing members 608 may be applied to the sill surface 30D over the sill flap 606D as previously described, and the watershed arrangement with the header flap 606A may be formed as previously described. The closure assembly 52 is then inserted into the rough opening 20 as previously described. This method is preferably employed when the closure assembly 616 is secured to the rough opening 20 by conventional means, for example, by nailing or bolting the closure assembly 52 to frame members 24 surrounding the rough opening 20, rather than with the curable foam 620.

Figure 22:
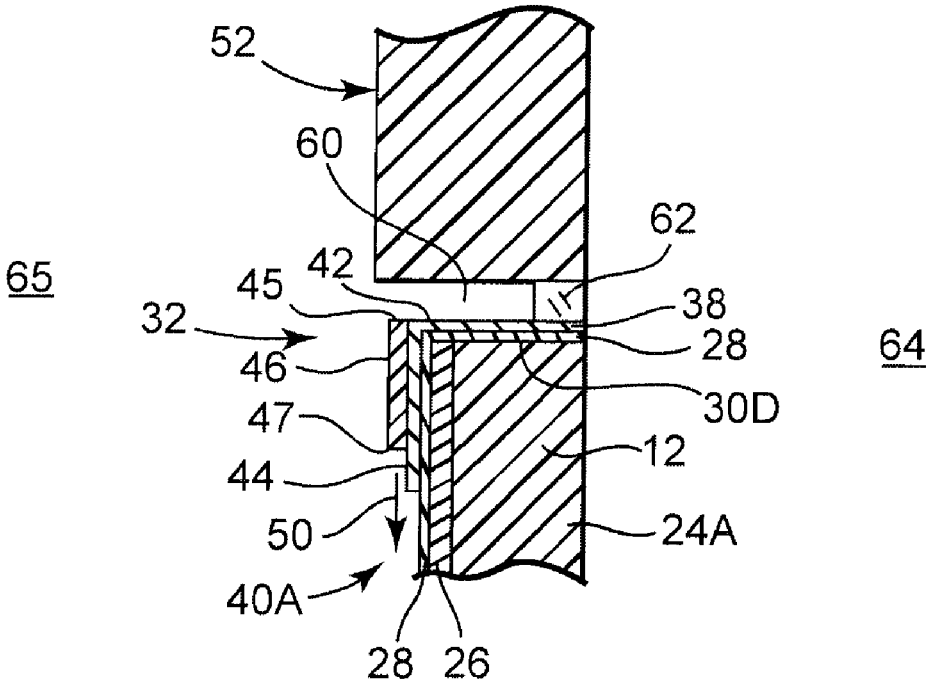
FIG. 22 is a cross sectional view of the drainage system of FIG. 1 with the closure assembly installed.

As best illustrated in FIG. 22, the rough opening 20 is larger than the closure assembly 52, creating gap 60 in which water may collect. As discussed previously, a drainage system 32 may be installed in the rough opening 20 in addition to the closure assembly 52. The closure assembly 52 is inserted into the rough opening 20 above the drainage system 32.

Figure 23:
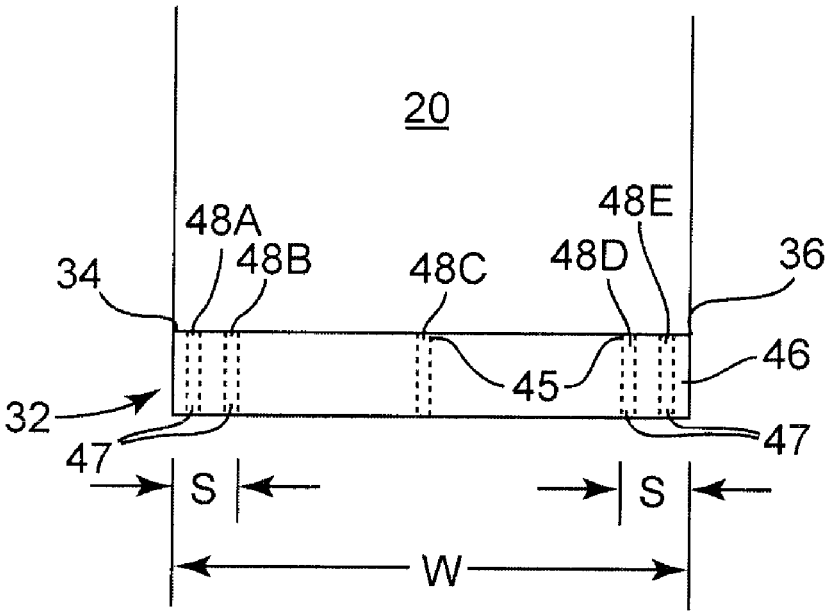
FIG. 23 is a front view of the drainage system of FIG. 1.

Referring generally to FIGS. 1 and 22-23, in one embodiment, the drainage system 32 includes a channel assembly 46 and a moisture barrier 38 positioned on the sill plate 24A. The channel assembly 46 is located on the generally vertical surface 44 of the moisture barrier 38 generally in front of the sill plate 24A.

As will be discussed in detail below, the channel assembly 46 includes one or more channels 48A-48E (referred to collectively as "48") that are configured to siphon water on the collection surface 42 from the channel entrance 45 in direction 50 and out a discharge opening 47 to a drainage area 40A. The channel assembly 46 is alternately a material that transports water from the collection surface 42 to the discharge opening 47, such as for example the polymeric foam and scrim sheathing disclosed in U.S. Pat. Nos. 6,536,176 (Nordgren et al.) and 7,100,337 (Nordgren et al.), which are hereby incorporated by reference. As used herein, "siphon" refers to conduit that uses the weight of a liquid to pull the liquid from the higher level to a lower level.

The channels 48 can be located anywhere along the width W of the rough opening 20. Most water penetration, however, occurs between a closure assembly 52 and the vertical inner surfaces 30B, 30C of the rough opening 20. Water tends to concentrate on the collection surface 42 near the bottom corners 34, 36 of the rough opening 20. As used herein, the term "bottom corner" also refers to the intersection of a sill plate and a mullion separating adjacent closure assemblies, or the intersection of a sill plate and two vertical surfaces of adjacent closure assemblies. In the preferred embodiment, the channels 48 are concentrated near the bottom corners 34, 36. In one embodiment the channels 48A, 48B, 48C, 48D and 48E are located within a distance S from the bottom corners 34, 36. The distance S is preferably less than 4 inches, and more preferably less than 2 inches, and most preferably less than 1 inch.

Interior seal 62 is optionally located near an interior side 64 of the sill plate 24A to prevent water that collects in the gap 60 from migrating toward the interior 64 of the structure 22. In embodiments where the collection surface 42 is generally horizontal, the interior seal 62 is preferably included. Because the gap 60 is open to an exterior side 65 of the closure assembly 52 at least where any leaks are occurring, and likely through the channels 48 as well, the air pressure within the gap 60 will tend to be the same as the air pressure at the exterior side 65 of the closure assembly 52. The seal 62 isolates the gap 60 from air pressure on the interior side 64. This feature helps to ensure that the air pressure within the gap 60 is never lower than the air pressure on the exterior side 65, which could cause moisture to flow up the channels 48A-48E and into the gap 60.

The drainage system 32 removes moisture from the gap 60 in the following manner. As moisture leaks into the rough opening 20 from any location around the closure assembly 52, the moisture flows downwardly into the gap 60 under the force of gravity and collects on the collection surface 42. The collection surface 42 is water impermeable, so the sill plate 24A is protected from water damage.

Eventually, due to random accumulation and flow of moisture across the collection surface 42, or because the collection surface 42 is completely covered, moisture accumulates over the channel entrances 45. Surface tension in the water molecules will for a time prevent the moisture from flowing down the channels 48A-48E. However, as moisture continues to accumulate, the weight of the water causes the water immediately adjacent the channel entrances 45 to flow down the channels 48 and out the discharge openings 47 into the drainage area 40A.

As water flows down the channels 48, a vacuum is created above the draining water, which draws more water down from the channel entrances 45, and so on. The negative or vacuum pressure of the descending water is strong enough to cause water on the collection surface 42 to be pulled towards the channel entrances 45. In this manner, moisture collecting on the collection surface 42 is removed to the drainage area 40A.

Because the channels 48 generate sufficient vacuum pressure to pull moisture from across the collection surface 42 towards the channel entrance 45, it is unnecessary for the collection surface 42 to be tilted or angled toward the channel assembly 46. Thus, a drainage system 32 in accordance with embodiments of the present invention does not require substantial modifications to the closure assembly 52 installation procedures, nor to the closure assembly 52 or rough opening 20, as previously described.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A closure assembly for installation in a rough opening of a structure having an interior side facing an interior of the structure and an exterior side facing an exterior of the structure and including frame members surrounding the rough opening, the closure assembly having an interior side for facing toward the interior of the structure and an exterior side for facing toward the exterior of the structure and comprising:

a window frame;

a glazing panel located in the window frame;

a plurality of engagement members positioned around a perimeter of the closure assembly, each of the engagement members being secured against the window frame and including a stop portion adapted to abut against one of the frame members to limit a depth that the closure assembly is inserted into the rough opening and to be secured against one of the frame members surrounding the rough opening; and a sealing member including an adhesive, a removable release liner, a proximal portion, and a distal portion, the distal portion of the sealing member being adapted to be folded against the structure once the closure assembly is installed in the rough opening, the proximal portion of the sealing member being secured to the engagement members, and the sealing member being configured to be folded such that the distal portion of the sealing member is transitioned from a position extending toward the interior side of the closure assembly, to a position extending toward the exterior side of the closure assembly, and to a position into engagement with the exterior side of the structure, the sealing member comprising a continuous segment of water impermeable material attached to, and extending continuously around, an entire perimeter of the closure assembly, the sealing member forming a water impermeable seal between the sealing member and the closure assembly.

2. The closure assembly of claim 1 wherein the sealing member comprises no seams.

3. The closure assembly of claim 1 wherein the sealing member is molded without seams.

4. The closure assembly of claim 1 wherein the sealing member comprises:

a first portion that engages with the closure assembly and comprises a first material; and a second portion that engages with the rough opening and comprises a second material.

5. The closure assembly of claim 1 wherein the sealing member comprises extruded lineal sections processed to a shape corresponding to the perimeter of the closure assembly.

6. The closure assembly of claim 1 wherein the sealing member is co-extruded into lineal sections from two or more materials.

7. The closure assembly of claim 1 wherein the sealing member comprises at least one continuous corner seal.

8. The closure assembly of claim 1 wherein a seam in the sealing member is positioned at a location other than a corner of the closure assembly.

9. The closure assembly of claim 1 wherein the sealing member is adhesively attached to the closure assembly.

10. The closure assembly of claim 1 comprising a securing member attached to the closure assembly adapted to secure the closure assembly in the rough opening.

11. The closure assembly of claim 1 comprising an adhesive layer on the sealing member covered by a removable release liner.

12. The closure assembly of claim 1 comprising a foam material located between the closure assembly and the rough opening.

13. The closure assembly of claim 12 wherein the foam material comprises the sole structural attachment of the closure assembly to the structure.

14. The closure assembly of claim 1 comprising finish trim attached to an interior portion of the closure assembly at a remote location.

15. The closure assembly of claim 1 comprising a drainage system located in the rough opening below the closure assembly.

16. A closure assembly for installation in a rough opening of a structure, the structure having an interior side facing an interior of the structure and an exterior side facing an exterior of the structure and including frame members surrounding the rough opening, the closure assembly having an interior side to be positioned toward the interior of the structure and an exterior side to be positioned toward the exterior of the structure, the closure assembly comprising:

a window frame having a front and a back and including a plurality of window frame members, the window frame being configured to be disposed within the rough opening;

a glazing panel located in the window frame;

a sealing member having an inner portion and an outer portion, the sealing member comprising a continuous segment of water impermeable material attached to and extending around an entire perimeter of the closure assembly, the sealing member forming a water impermeable seal between the sealing member and the closure assembly; and a plurality of cladding members secured to a respective one of the window frame members at the front of the window frame, each of the plurality of cladding members having a first wall, a second wall, and a third wall connecting the first and second walls, the first, second and third walls defining an open interior for receiving the inner portion of the sealing member;

wherein the sealing member is configured to be positioned with the inner portion and the outer portion extending toward an interior side of the closure assembly and folded such that the outer portion is positioned against and adhered to the exterior side of the structure.

* * * * *